US006406595B1

(12) United States Patent
Aidun

(10) Patent No.: US 6,406,595 B1
(45) **Date of Patent: *Jun. 18, 2002**

(54) METHODS AND APPARATUS TO ENHANCE PAPER AND BOARD FORMING QUALITIES

(75) Inventor: Cyrus K. Aidun, Marietta, GA (US)

(73) Assignee: Institute of Paper Science and Technology, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/645,829

(22) Filed: Aug. 25, 2000

Related U.S. Application Data

(60) Division of application No. 09/534,690, filed on Mar. 24, 2000, now Pat. No. 6,153,057, which is a continuation-in-part of application No. 09/212,199, filed on Dec. 15, 1998, now abandoned, which is a continuation-in-part of application No. 08/920,415, filed on Aug. 29, 1997, now Pat. No. 5,876,564, which is a continuation-in-part of application No. 08/546,548, filed on Oct. 20, 1995, now Pat. No. 5,792,321.

(51) Int. Cl.[7] ..... D21F 11/00; D21F 1/02

(52) U.S. Cl. ..... 162/216; 162/212; 162/343; 162/336; 162/339

(58) Field of Search ..... 162/216, 212, 162/336, 339, 340, 202, 213; 366/336–337, 332, 340, 166

(56) References Cited

U.S. PATENT DOCUMENTS 2,832,268 A * 4/1958 Boone et al. ..... 162/343

(List continued on next page.)

FOREIGN PATENT DOCUMENTS

| | | |
|---|---|---|
| CA | 1320860 | 8/1993 |
| DE | G 93 04 736.3 U1 | 7/1993 |
| EP | 0 364 242 | 4/1990 |
| SU | 1490205 A1 | 6/1989 |
| SU | XP 002045495 | 6/1989 |

OTHER PUBLICATIONS

Product Brochure, "Step Diffusor Headboxes", Escher Wyss Paper Technology, Sulzer–Escher Wyss GmbH, Ravensburg, Federal Republic of Germany, 1989, 33 pages.

(List continued on next page.)

*Primary Examiner*—Jose Fortuna
(74) *Attorney, Agent, or Firm*—Fitch, Even, Tabin & Flannery

(57) ABSTRACT

Methods and apparatus to enhance paper and board forming qualities with insert tubes and/or a diffuser block in the paper forming machine headbox component which generates vorticity in the machine direction (MD) which is superimposed on the streamwise flow to generate a swirling or helical flow through the tubes of the diffuser block. Tubes of the diffuser block are designed such that the direction of the swirl or fluid rotation of the paper fiber stock may be controlled and the direction thereof is controlled in such a way to provide effective mixing, coalescence and merging of the jets of fluid emanating from the tubes into the converging section, i.e., nozzle chamber of the headbox. Also disclosed is the effective mixing of the jets generating cross-machine direction (CD) shear between the rows of jets that form at the outlet of the tubes inside the nozzle chamber of the headbox to align paper fibers in the cross-machine direction. In another alternate embodiment, the generation one or more counter-rotating vortex pairs (CVPs) may be set up inside each tube instead of a single vortex per tube. The counter-rotating vortices inside the tubes result in more effective interaction of the jets once leaving the tubes. The CVPs may be generated in four orientations in the tube block, generating controlled axial vortices promoting mixing of the jets of paper stock from the tubular elements as the jets flow into the nozzle chamber to a uniform flow field of stock at the slice opening for the rectangular jet.

20 Claims, 26 Drawing Sheets

U.S. PATENT DOCUMENTS

| | | | | | |
|---|---|---|---|---|---|
| 3,846,229 | A | | 11/1974 | Kallmes | |
| 4,087,321 | A | | 5/1978 | Schultz et al. | |
| 4,104,116 | A | * | 8/1978 | Koskimies | 162/343 |
| 4,179,222 | A | | 12/1979 | Strom et al. | |
| 4,539,075 | A | | 9/1985 | Majaniemi | |
| 4,604,164 | A | | 8/1986 | Fujiwara et al. | |
| 4,643,584 | A | | 2/1987 | Allocca | |
| 4,765,868 | A | * | 8/1988 | Fujiwara | 162/343 |
| 4,812,208 | A | | 3/1989 | Yuasa et al. | |
| 4,936,689 | A | | 6/1990 | Federighi et al. | |
| 5,000,227 | A | | 3/1991 | Beran et al. | |
| 5,019,215 | A | | 5/1991 | Fortier et al. | |
| 5,110,416 | A | | 5/1992 | Linsuri et al. | |
| 5,124,002 | A | | 6/1992 | Kade | |
| 5,183,537 | A | | 2/1993 | Hergert et al. | |
| 5,196,091 | A | | 3/1993 | Hergert | |
| 5,304,285 | A | | 4/1994 | Meinecke et al. | |
| 5,316,383 | A | * | 5/1994 | Begeman et al. | 366/160 |
| 5,484,203 | A | | 1/1996 | King et al. | |
| 5,549,792 | A | | 8/1996 | Begemann et al. | |
| 5,603,807 | A | | 2/1997 | Heinzmann | |
| 5,622,603 | A | | 4/1997 | Begemann et al. | |
| 5,792,321 | A | | 8/1998 | Aidun | |
| 5,876,564 | A | | 3/1999 | Aidun | |
| 6,153,057 | A | * | 11/2000 | Aidun | 162/343 |

OTHER PUBLICATIONS

Dr. Ruediger Kurtz and Dr. Werner Seebas, "Influence of Headbox Design on Web Formation and Product Quality—and Update on the Escher Wyss Step Diffusor Headbox", paper given at the PIRA Paper and Board Division Conference "Paper Machine Headboxes—an Update", Nov. 1989, Blackburn, United Kingdom, 6 pages.

W. Felsch: Papiermacher Taschenbuch, 1989, Dr. Curt Haefner Verlag, Heidelberg, pp. 2–5 and 128–137 ) (Section on Page Machines from The Papermaker Handbook, 5th edition).

Bulletin KSM–6, "Static Mixing Technology", Koch Engineering Company, Inc., Wichita, Kansas, Copyright 1991, 16 pages.

* cited by examiner

METHODS AND APPARATUS TO ENHANCE PAPER AND BOARD FORMING QUALITIES

CROSS-REFERENCE TO RELATED APPLICATIONS

This is a divisional of prior application Ser. No. 09/534,690, filed Mar. 24, 2000 now U.S. Pat. No. 6,153,057 which is a continuation-in-part of prior application Ser. No. 09/212,199, filed Dec. 15,1998, abandoned, which is a continuation of prior application Ser. No. 08/920,415, filed Aug. 29, 1997, now U.S. Pat. No. 5,876,564, which is a continuation-in-part of prior application Ser. No. 08/546,548, filed Oct. 20, 1995, now U.S. Pat. No. 5,792,321, which is hereby incorporated herein by reference in its entirety.

BACKGROUND OF THE INVENTION

1. Field of the Invention

The inventions relate generally to increased productivity and formation quality in paper forming machine headbox components by hydrodynamic optimization of paper and board forming. More particularly, the inventions relate to the generation of microturbulence and CD shear in jets of paper fiber stock. The generated flow field may be provided as one or more counter-rotating vortex pairs (CVP) within diffuser tubes. Enhanced mixing of the stock is thus provided as jets of paper fiber stock emanate from a diffuser block for coupling a distributor to a nozzle chamber in a paper forming machine headbox for discharging paper fiber stock upon a wire component.

2. Background and Description of Related Art

The quality of paper and the board forming, in manufacture, depends significantly upon the uniformity of the rectangular jet generated by a paper forming machine headbox component for discharging paper fiber stock upon the wire component of the paper forming machine. Attempts to establish uniform paper stock flow in the headbox component, particularly the nozzle chamber, and to improve paper fiber orientation at the slice output of the headbox have involved using a diffuser installed between the headbox distributor (inlet) and the headbox nozzle chamber (outlet). The diffuser block enhances the supply of a uniform flow of paper stock across the width of the headbox in the machine direction (MD). Such a diffuser box typically includes multiple conduits or tubular elements between the distributor and the nozzle chamber which may include step widening or abrupt opening changes to create turbulent flows for deflocculation or disintegration of the paper fiber stock to ensure better consistency of the stock. High quality typically means good formation, uniform basis weight profiles, uniform sheet structure and high sheet strength properties. These parameters are affected to various degrees by paper fiber distributions, fiber orientations, fiber density and the distributions of fines and fillers. Optimum fiber orientations in the XY plane of the paper and board webs which influences MD/CD elastic stiffness ratios across the width is of significant importance in converting operations and end uses for certain paper grades.

Conventional paper forming apparatus used primarily in the paper and board industry consists of a unit which is used to transform paper fiber stock, a dilute pulp slurry (i.e., fiber suspended in water at about 0.5 to 1 percent by weight) into a rectangular jet and to deliver this jet on top of a moving screen (referred to as wire in the paper industry). The liquid drains or is sucked under pressure through the screen as it moves forward leaving a mat of web fiber (e.g., about 5 to 7 percent concentration by weight). The wet mat of fiber is transferred onto a rotating roll, referred to as a couch roll, transporting the mat into the press section for additional dewatering and drying processes.

The device which forms the rectangular jet is referred to as a headbox. These devices are anywhere from 1 to 9 meters wide depending on the width of the paper machine. There are different types of headboxes used in the industry. However, there are some features that are common among all of these devices. The pulp slurry (referred to as stock) is transferred through a pipe into a tapered section, the manifold, where the flow is almost uniformly distributed through the width of the box. The pipe enters the manifold from the side and therefore, there must be a mechanism to redirect the flow in the machine direction. This is done by a series of circular tubes which are placed in front of the manifold before the converging zone or nozzle chamber of the headbox. This section is referred to as the tube bundle, the tube bank or the diffuser block of the headbox. These tubes are either aligned on top of each other or are placed in a staggered pattern. There are anywhere from a few hundred to several thousand tubes in a headbox.

The tubes in current headboxes have a smooth surface starting from a circular shape in the manifold side and going through one or two step changes to larger diameter circular sections. Some tubes converge into a rectangular outlet (some with rounded edges) at the other end opening to the converging zone of the headbox. Analysis shows that the flow entering the tube may start to recirculate generating vorticity in the machine direction. The sign of the vorticity vector depends on the location of the tube. Very often, there is a pattern that develops as a natural outcome of the tube pattern structure and the structure of the headbox. In current machines, there is no control on the direction or strength of the vortices in the tubes. The tubes all have flat smooth internal surface and the flow pattern and secondary flow inside the tubes is governed by the inlet and outlet conditions. The machine direction vorticity could be positive or negative depending on the inlet and outlet conditions which in turn depend on the location of the tube in the tube bank.

SUMMARY OF THE INVENTION

The present invention relates to a concept and method of generating one or more counter-rotating vortex pairs (CVP) inside each tube. The counter-rotating vortices inside the tubes result in more effective interaction of the jets once leaving the tubes. Advantageously the generation of small scale turbulent flows with the defined vortices of the jets avoids large scale hydrodynamic problems of secondary flows, flow instabilities, boundary-layer separation and other hydrodynamically-induced non-uniformities in the forming section nozzle chamber of the paper forming machine headbox component, avoiding the problems of: twist/warp in board grades; non-uniform basis-weight; non-uniform fiber orientation; non-uniform moisture profile; cockling and diagonal curl in printing paper; and streaking (jagged) dry line on the forming table or wire component.

A novel concept is described to control the formation of secondary flow in the tubes in order to achieve a superior flow field inside the converging zone of the headbox. Any mechanism used to control or enhance the secondary flow inside the tubes and in the tube bank region to achieve a certain flow property in the converging zone of the headbox is part of this concept. Thus, the concept relates to the modification of the flow inside the tube bank by altering the internal surface geometry of current tubes or tube inserts. The internal surfaces of all of the current tubes or tube inserts are either circular and therefore axisymmetric (type I), or, they start from a circular inlet and eventually converge into a rectangular outlet (type II) with a four fold symmetry (i.e., the entire tube can be divided into symmetric regions by two diagonal cross-sectional planes, one vertical cross-sectional plane and one horizontal cross-sectional plane. The new concept is to modify the geometry of the type I and/or inserts such that the internal surface is no longer axisymmetric or non-axisymmetric, and to modify the internal geometry of the type II tubes such that the internal geometry of the tube or the insert is no longer four fold symmetric. One described embodiment modifies the internal geometry of each tube in order to generate machine-direction (MD) vorticity and subsequently to arrange the tube or the insert in such a manner so that all the jets in each row of the tube bundle form with the same sign of MD vorticity vector and the jets in each column form with alternating sign of the MD vorticity. This generates shear layers which would result in cross-machine orientation of fibers and therefore would increase the strength and other physical properties in the CD while providing effective mixing and turbulent generation between tubes adjacent to each other in each row.

Another described embodiment modifies the internal geometry of each tube insert or tube in order to generate machine-direction (MD) vorticity and subsequently to arrange the tubes or the inserts in such a manner so that all the jets in each row and column of the tube bundle form with the same sign of MD vorticity vector. This results in strong mixing and dispersion of the fibers and fillers and therefore better uniformity in fiber and filler distribution in the sheet.

Another mechanism to generate axial vorticity inside the tubes of a headbox is to have a device, a tube insert, wherein a flat section at the manifold side is followed by a converging curved section, followed by a straight tube section, and where, one or more inclined fins or grooves are placed on the flat section or on the flat and the converging curved section of the headbox tube or insert nozzle of the headbox tube. The purpose of inclined fins or grooves is to control the defined direction or orientation of the axial vortices generated inside the tubes. The converging section of the insert nozzle or tube will accelerate the fluid and increase the angular velocity of the fluid, consequently, increasing the strength of the vortex as the fluid moves toward the straight (constant diameter) section of the tube.

In another alternate embodiment, the generation one or more counter-rotating vortex pairs (CVPs) may be set up inside each tube instead of a single vortex per tube. The counter-rotating vortices inside the tubes result in more effective interaction of the jets once leaving the tubes. The CVPs may be generated in four orientations in the tube block, to provide methods and apparatus to enhance paper and board forming qualities which overcomes the various problems of the prior art by providing CVP vortex forming means for a plurality of tubular elements for generating controlled axial vortices in the machine direction promoting mixing of the jets of stock from the tubular elements as the jets flow into the nozzle chamber to a uniform flow field of stock.

Briefly, the invention relates to methods and apparatus to enhance paper and board forming qualities with insert tubes and/or a diffuser block in the paper forming machine headbox component which generates vorticity in the machine direction (MD) which is superimposed on the streamwise flow to generate a swirling or helical flow through the tubes of the diffuser block. Tubes of the diffuser block are designed such that the direction of the swirl or fluid rotation of the paper fiber stock may be controlled. Also disclosed is the effective mixing of the jets generating cross-machine direction (CD) shear between the rows of jets that form at the outlet of the tubes inside the nozzle chamber of the headbox to align paper fibers in the cross-machine direction. In another alternate embodiment, the generation one or more counter-rotating vortex pairs (CVPs) may be set up inside each tube instead of a single vortex per tube. The counter-rotating vortices inside the tubes result in more effective interaction of the jets once leaving the tubes. The CVPs may be generated in four orientations in the tube block, generating controlled axial vortices promoting mixing of the jets of paper stock from the tubular elements as the jets flow into the nozzle chamber to a uniform flow field of stock at the slice opening for the rectangular jet.

The appended claims set forth the features of the present invention with particularity. The invention, together with its objects and advantages, may be best understood from the following detailed description taken in conjunction with the accompanying drawings.

DETAILED DESCRIPTION OF THE PREFERRED EMBODIMENT

Figure 1A:
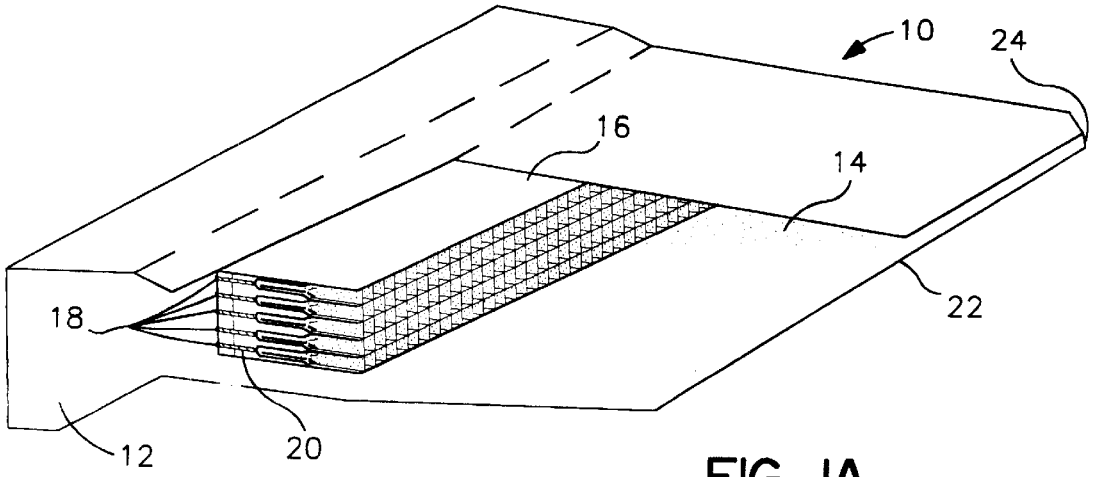
FIG. 1A shows a paper forming machine headbox component used with a diffuser block exposed to show vortex forming means provided for a plurality of the tubular elements of the diffuser block in accordance with the invention.

Reference will now be made in detail to the present preferred embodiments, examples of which are illustrated in the accompanying drawings. FIG. 1A illustrates an embodiment of a paper forming machine headbox component 10 for receiving a paper fiber stock and generating a rectangular jet therefrom for discharge upon a wire component moving in a machine direction (MD). A distributor 12 is provided for distributing the paper fiber stock flowing into the headbox component 10 in a cross-machine direction (CD) which would be generally perpendicular to the machine direction of the wire component in a conventional hydraulic headbox. It is important to note however, that the present invention may also be embodied in a conventional air-cushioned headbox as well as the hydraulic headbox. The distributor 12 is provided to supply a flow of paper fiber stock across the width of the headbox 10 in the machine direction. A nozzle chamber 14 is shown having an upper surface and a lower surface converging to form a rectangular output lip defining a slice 22 opening for the rectangular jet at opening 24. As shown in cross section in FIG. 1B, the paper fiber stock flows as indicated by the arrows in the nozzle chamber 14 to output the rectangular jet 30 upon the wire 32 partially shown in FIG. 1B.

Figure 1B:
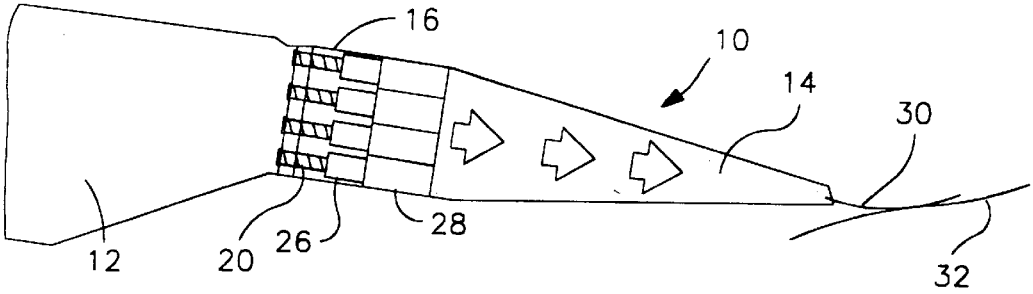
FIG. 1B shows a cross-sectional view thereof.

A diffuser block 16 is provided to couple the distributor 12 to the nozzle chamber 14. As illustrated in FIGS. 1A and 1B, the diffuser block 16 includes a multiplicity of individual tubular elements 18 disposed between the distributor 12 and the nozzle chamber 14, the presently described embodiment includes vortex forming means 20 provided for a plurality of the tubular elements 18. The vortex forming means 20 embodied herein may be provided for a subset or a plurality of the multiple tubular elements 18 for generating controlled axial vortices in the machine direction promoting mixing of the jets of the stock from the tubular elements 18, as the jets flow into the nozzle chamber to a uniform flow field of stock at the slice opening 22 for the rectangular jet 30 from the rectangular opening 24 at the slice 22.

As FIG. 1B illustrates in cross section, steps 26 and 28 as might be found in a conventional diffuser block for the purpose of breaking up deflocculating or disintegrating the paper fiber stock to enhance the uniformity thereof. As already described a step diffuser block is generally provided in conventional headboxes, and the present embodiment may or may not require the use of such a step diffuser, but for the purpose of the described embodiment, the step diffuser is provided as shown.

Figure 1C:
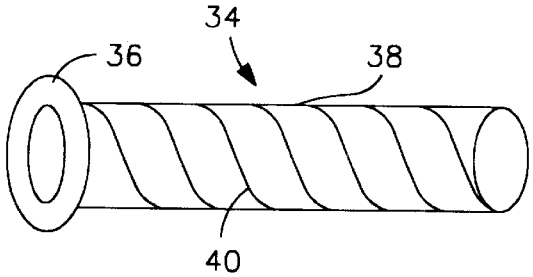
FIG. 1C shows an insert tube embodying vortex forming means also in accordance with the invention for insertion in the diffuser block of a conventional paper forming machine headbox component.

FIG. 1C shows an insert tube 34 which is insertable in a diffuser block for coupling the distributor to the nozzle chamber in a paper forming machine headbox for discharging paper fiber stock upon a wire component moving in a machine direction. The diffuser block in conventional machines includes a multiplicity of individual tubular elements as already discussed and also provide for the ability for such inserts, typically smooth cylindrical tubular inserts for varying diameter of the individual tubular elements. However, the inserts of the described embodiment and shown herein are typically used to generate vortices within such tubes and thus, asymmetric or non-axisymmetric surface with ridges or fins or grooves as opposed to smooth axisymmetric inner surfaces are employed. The tubular elements and the insert tubes are oriented axially in the machine direction and arranged as a matrix of rows and columns for generating multiple jets of paper fiber stock flowing into the nozzle chamber 14. The insert tube 34 includes a flat section inlet 36 for receiving the stock from the distributor, which also serves as a shoulder or rim for securing the insert tube 34 in the diffuser block 16. The insert tube 34 embodiment also includes an elongated section outlet 38 connected to the flat section inlet 36 for directing the jets of the paper fiber stock through the tubular elements of the diffuser block 16 as the jets flow towards the nozzle chamber 14. Also the vortex forming means 40 are provided for the insert tube 34 for generating the controlled axial vortices in the machine direction to promote mixing of the jets from the elongated section outlet as the jets flow toward the nozzle chamber 14. Herein, the vortex forming means include an asymmetric interior surface as shown in FIG. 1C within the elongated section outlet 38 for generating the controlled axial vortex therein. More specifically, the asymmetric interior surface has a spiral pitch defining a helical path as shown within the tubular elements to generate the controlled axial vortices as the stock travels along the helical path in the elongated section outlet 38. Thus, as described, for tubes in existing headboxes, the insert tube 34 may be constructed of plastic, metal, ceramic or composite inserts with the spiral-shaped grooves, fins, ridges or guides of various form at the inner surface. One such feature is to form spiral-shaped grooves or patterns through the inner surface of the insert as shown. These inserts can be easily placed inside the tubes to generate the desired machine-direction vorticity in the tube. The inserts such as tube insert 34 may be placed inside the tubes at the distributor or manifold side of a headbox 10. The initial section of the insert at the inlet may start with a smooth surface before the vortex generating means, discussed above.

Figure 1D:
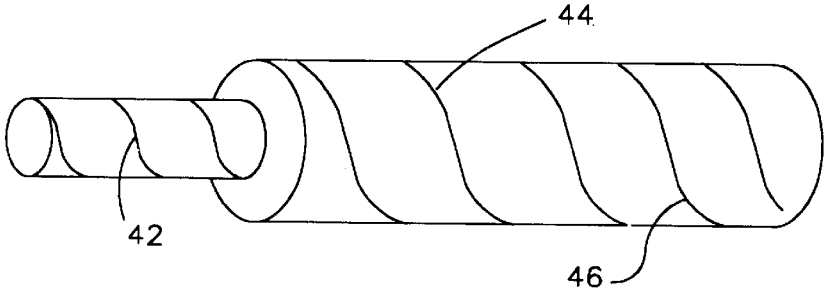
FIG. 1D illustrates a tubular element of a step diffuser block for generating controlled axial vortices therein.

Turning now to FIG. 1D, there are several ways to implement the described concept, e.g., the tubes have the feature of directing the flow in a manner to generate machine direction vorticity in a specific direction (i.e., with a specific vorticity vector sign, defined as positive (+) or negative (−) based on a right-hand rule). Thus, the sign of the secondary flow of the vorticity inside the tube is controlled by the spiral-shaped grooves, fins, ridges or guides of various form in the inner surface or such means for generating the vorticity. One such feature is to form spiral-shaped grooves or patterns through the inner surfaces of the tubes as shown in FIG. 1D, in a step diffuser box. As the fluid enters the tube from the manifold, the spiral grooves direct the flow in a recirculating manner generating or increasing the controlled vorticity in the machine direction. The grooves have increasing or decreasing pitch depending on the type of tube and the headbox design. As shown in FIG. 1D, the pitch of the spiral-shaped grooves may gradually change through the step diffuser tube as indicated by reference numerals 42, 44 and 46; note particularly the increased pitch between the groove 44 and the groove 46. The pitch of the grooves depends on the average MD velocity through the tube. If the MD velocity is very large, then the pitch may be considerably smaller than shown in the figure. Another means to generating the controlled vortices in addition or in place of the spiral grooves or fins, discrete sections of fins or ridges can be used to direct the stock in a helical pattern inside the tubes generating controlled MD vortices. The spiral-shaped grooves, fins or guides allow the fluid to gradually flow in the spiral-shaped pattern of the tube surface.

Figure 2A:
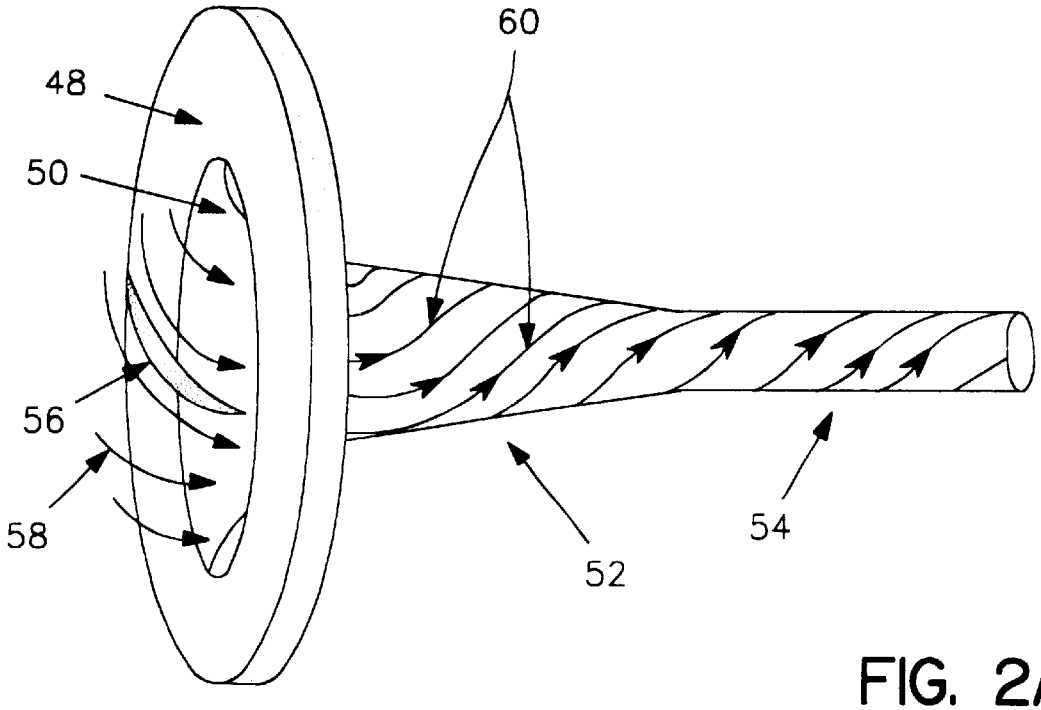
FIGS. 2A and 2B show an additional embodiment of the invention wherein fins or grooves at the inlet of the tubular element may be utilized to generate vortices and converging section can curved section forming an elongated portion near the inlet also generate controlled axial vortices within tubular elements.
Figure 2B:
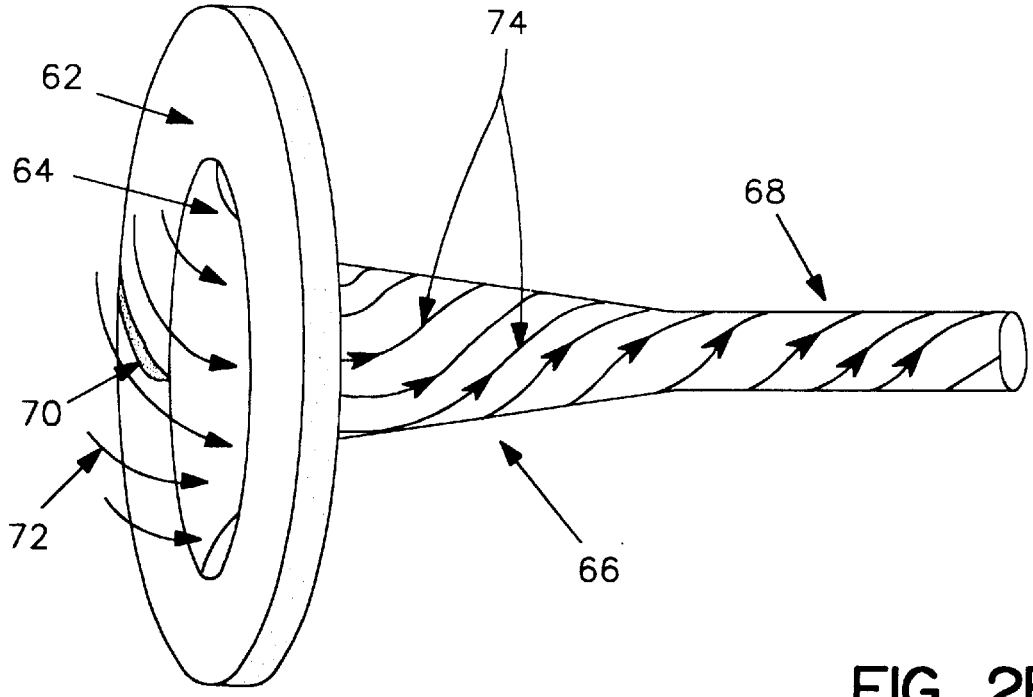

With reference to FIGS. 2A and 2B, additional tube insert embodiments are shown including vortex forming means as an inclined fin or groove 56 and 70 on flat section inlets 48 and 62 respectively. Such incline fins or grooves facilitate the generation of the controlled axial vorticity as the stock flows toward the elongated section outlet from the distributor 12 of the headbox 10. The mechanism of FIGS. 2A and 2B generate axial vorticity inside the tubes of the headbox wherein the flat section at the manifold or distributor side is followed by a converging curved section, herein curved sections 50 and 64 and converging portions 52 and 66 are provided as portions of the elongated section outlet connecting to elongated sections 54 and 68 respectively, in the two embodiments of FIGS. 2A and 2B. Where the inclined fin or groove, e.g., 56 or 70, is placed on the flat section, e.g., 48 or 62, or on the flat and the converging section of the headbox tube or insert nozzle of the headbox tube, the purpose of the inclined fin or groove is to control the direction of the vortex generated inside the tube as shown wherein inlet flow 58 is directed as a vortical flow pattern indicated by reference numeral 60 in FIG. 2A; and incoming flow 72 is directed as vortical flow 74 in the embodiment of FIG. 2B. The converging sections 52 or 66 of the insert tube will accelerate the fluid and increase the angular vorticity of the fluid, consequently increasing the strength of the vortex as the fluid flows towards the straight edge 54, or 68 of the tube. FIG. 2 shows the groove 56 as residing within the elongated outlet portion of the tube as well as on the flat section 48; while FIG. 2B provides the groove or fin 70 as residing solely on the flat surface 62. It should be noted that while a single fin or groove is shown on the tubes more fins may be desirable for creating the axial vorticity within the tubes as well as for ease of placement, orientation independence and the like for fitting such tubes into the diffuser block of conventional headboxes. The curved sections 50 and 64 may be incorporated into the elongated section and disposed between the flat section 48 and converging section 52 in FIG. 2A to facilitate the axial vorticity, and as such, provide additional vortex forming means as a curved section included along a portion of the converging section near the flat section for generating the controlled axial vortices as the paper fiber stock flows in the elongated section outlet.

Figure 3A:
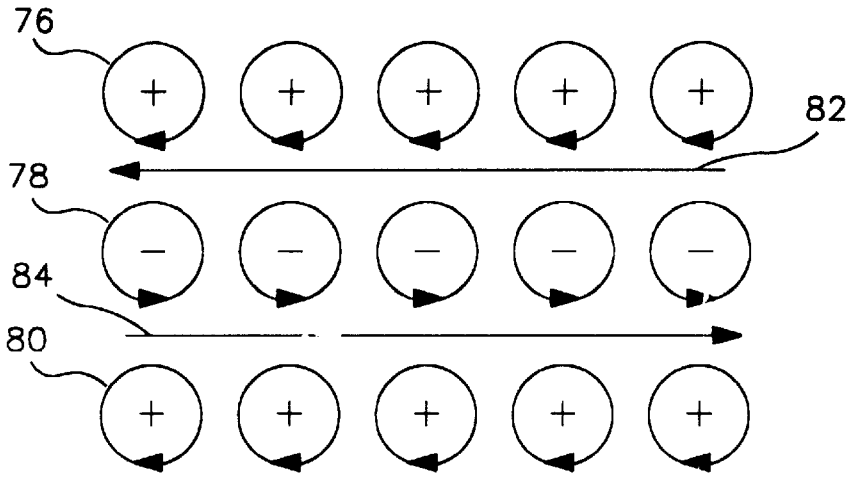
FIGS. 3A through FIG. 3H illustrate various controlled vortices configurations as positive and negative defined vortices emanating from the diffuser block to generate small scale turbulence between adjacent tubes for improved formation, and predetermined cross flows to achieve uniform stock flow in the nozzle chamber according to the invention.
Figure 3B:
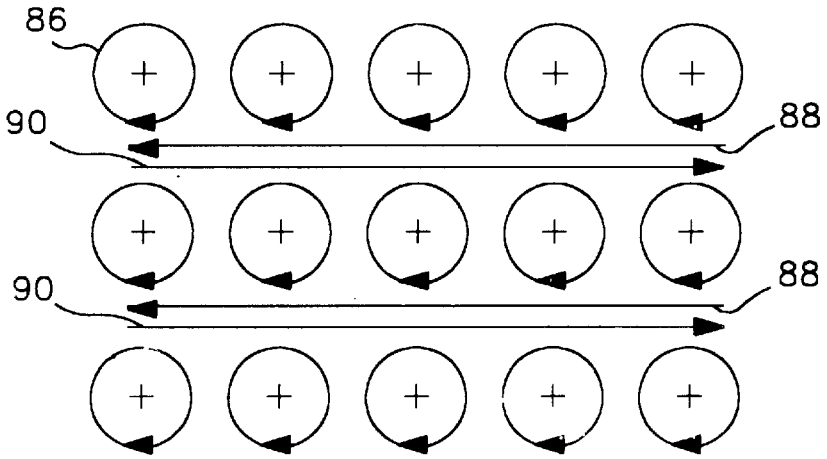
Figure 3C:
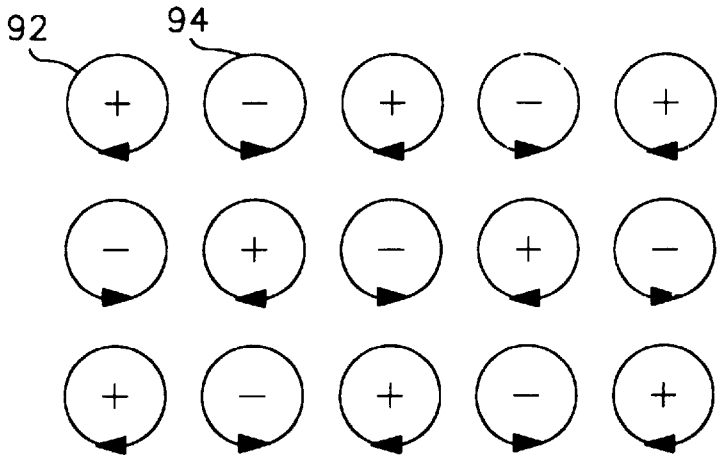

FIGS. 3A, 3B and 3C illustrate various methods of mixing jets of paper fiber stock emanating from a multiplicity of axially aligned tubes arranged as a matrix of rows and columns in a diffuser block coupled to a nozzle chamber in a paper forming machine headbox for discharging a uniform flow field of stock upon the wire component moving in the machine direction. As indicated, the MD components of vortices of the jets emanating from the tubes are indicated as positive defined or negative defined axial vortices in accordance with the convention of the right-hand rule and where here we use the convention that positive MD points into the surface of the figures. One could also use the convention that MD is the negative direction. Positive or negative jets refer to jets with positive or negative MD vorticity, respectively. A method described herein provides for the generation of positive jets of paper fiber stock emanating from the diffuser block in controlled axial vortices in the machine direction for a first plurality of the tubes, the direction of the vortex being directed in a first positive-defined direction about the axes of each of the first plurality of tubes and positioning at least one of the positive jets adjacent another one of the positive jets promoting mixing as the jets flow into the nozzle chamber. This is illustrated in FIG. 3A where the first row 76 of FIG. 3A and the bottom row 80 of FIG. 3A whereby small scale turbulence is introduced between the individual positively oriented jets of rows 76 and 80 as the fluid flow emanates from the tubes promoting mixing thereof. Small scale turbulence is also introduced between the individual negatively oriented jets of row 78 in FIG. 3A. In addition to the secondary vorticity of the jets promoting mixing of the fluid emanating from the tubes, the configuration of FIG. 3A also generates shear layers which would result in cross-machine orientation of fibers and therefore, would increase the strength and other physical properties in the cross-machine direction, as indicated by shear lo layers in between 82 and 84 with the inner-posed layer of negative defined rows of vorticity as indicated by reference numeral 78. The jet orientation of row 78 is provided according to the method by generating negative jets of paper fiber stock emanating from the diffuser block in controlled axial vortices in the machine direction for a second plurality of tubes, the direction of each vortex being directed in a second negative-defined direction about the axes of each of said second plurality of tubes and positioning at least one of the negative jets adjacent another one of the negative jets promoting mixing as the jets flow into the nozzle chamber, herein row 78. FIG. 3A illustrates desired flows for enhancing the strength of paper or board because the shear layers in the CD provide CD strength by the alternating MD vorticity direction of the secondary flow of the jets from the tubes in each row of tubes resulting in shear layers which align more fibers in CD.

An alternate concept of modifying the internal geometry of each tube in order to generate machine direction vorticity and subsequently arrange the tubes or inserts in a manner such that all the jets of each row and column of the tube bundle form the same sign of MD vorticity vector is shown in FIG. 3B. This results in strong mixing and dispersion of the fibers and fillers and therefore better uniformity in fiber and filler distribution in the sheet and enhanced formation. As shown in FIG. 3B all of the rows and columns have the orientation same indicated by reference numeral 86, namely a positively defined orientation of vorticity which results in turbulent shears as indicated by reference numeral 88 and 90. FIG. 3B shows an orientation best for mixing where uniform dispersion is a criteria having emphasis over strength; such as in tissue or light-weight paper applications.

FIG. 3C illustrates alternating sign vorticity 92 and 94 throughout the rows and columns of the tube bank which provides the configuration of Case 2 discussed below in connection with FIGS. 5A–5H wherein the described counter-rotating pattern of adjacent jets provides better mixing over jets lacking vorticity discussed further below. Computer analysis for headboxes employing the configuration of FIG. 3C shows the ability to achieve more uniform flow of the paper fiber stock within the nozzle chamber making secondary jets at the slice weaker and thus noticeable improvement in uniformity.

Figure 3D:
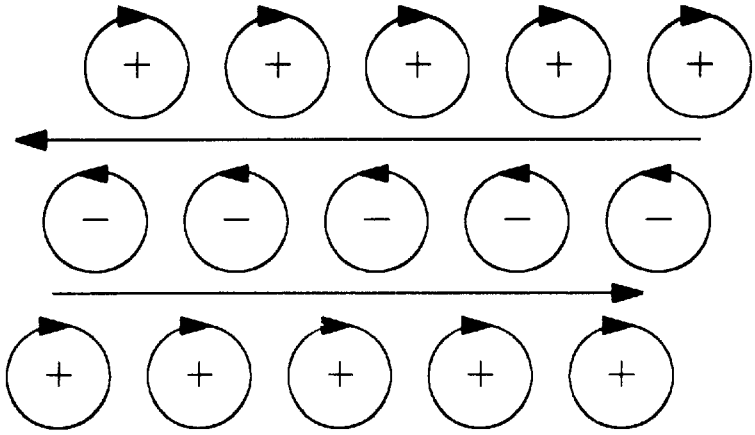
Figure 3E:
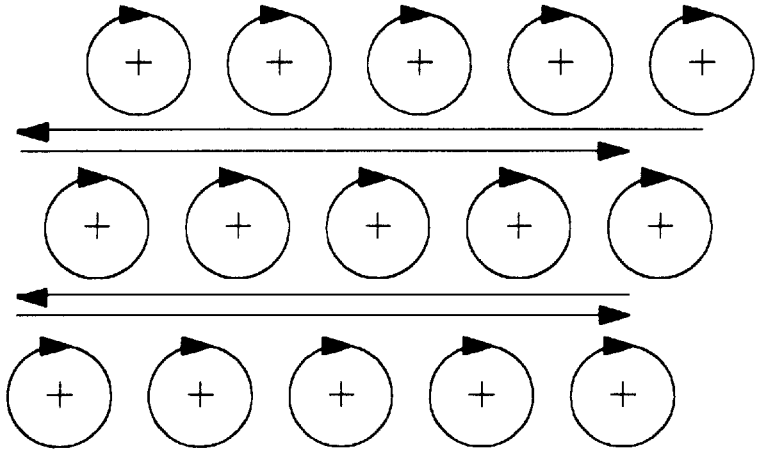
Figure 3F:
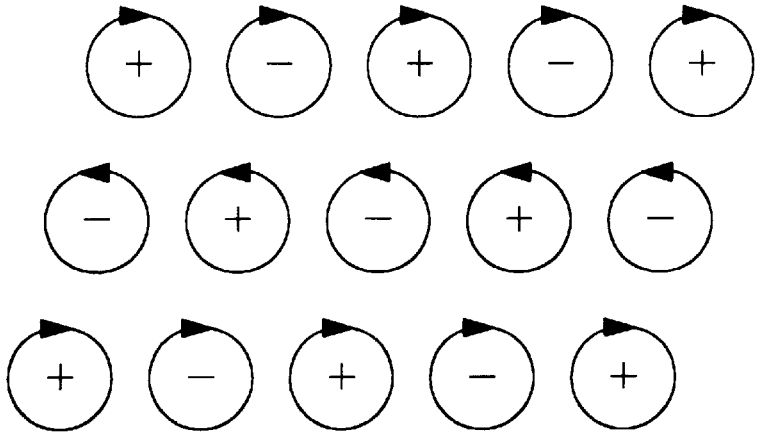

FIGS. 3D, 3E and 3F show additional patterns of the tubes for generating vortices of defined orientation, herein the matrix of rows and columns in the diffuser block being either vertical or inclined columns and introducing the vortex patterns in staggered tube arrangements. FIGS. 3D, 3E and 3F respectively provide patterns similar to those discussed above in connection with FIGS. 3A, 3B and 3C, wherein the individual secondary vorticity of the jets emanating from the tubes is provided in a staggered pattern in FIGS. 3D–3F. In FIG. 3D, the alternating MD vorticity direction of the secondary flow of the jets from the staggered tubes results in shear layers which would align more fibers in the CD. In FIG. 3E, the MD vorticity direction of the secondary flow of the jets from the staggered tubes results in enhanced fiber dispersion and mixing of the fillers in the paper fiber stock. In FIG. 3F, the alternating checkerboard MD vorticity direction of the secondary flow of the jets from the staggered tubes results in effective mixing and fiber dispersion.

Figure 3G:
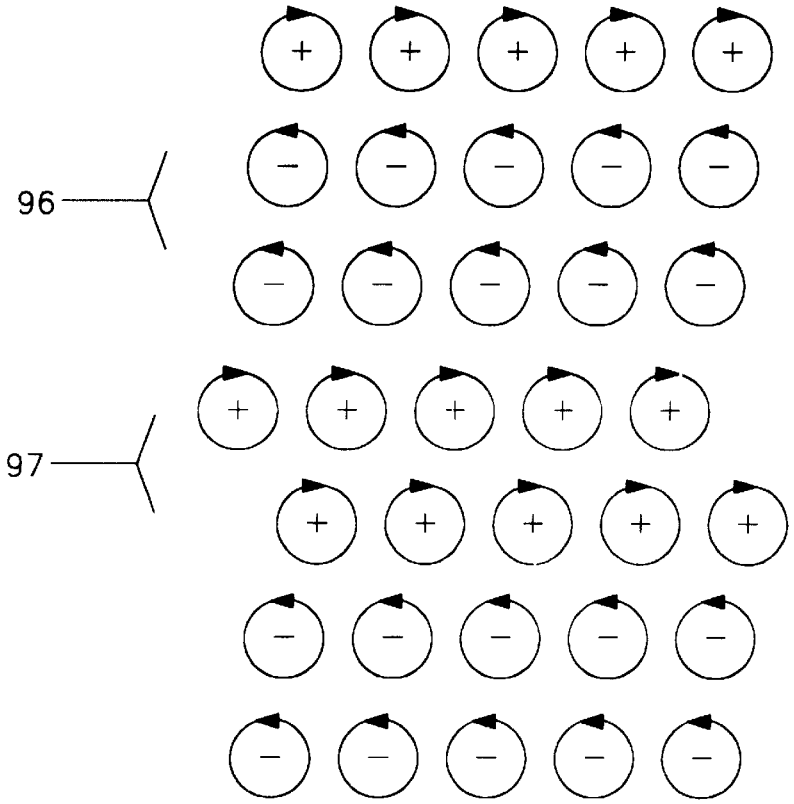
Figure 3H:
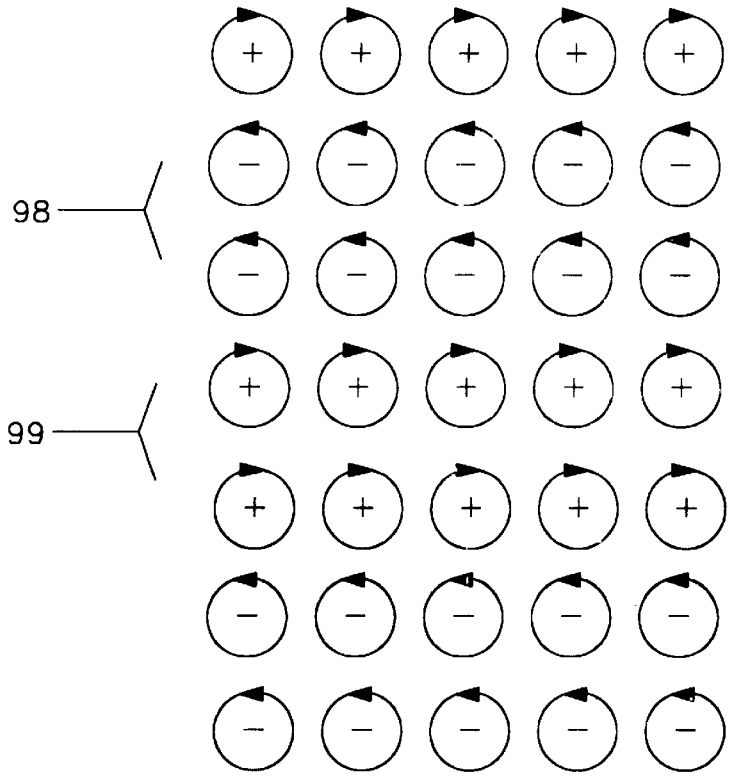

Additionally, FIG. 3G illustrates plural row pairs of common secondary vorticity of the jets from the tubes in a staggered pattern, herein a pair of negatively oriented rows 96 being provided above a pair of positively oriented rows 97 in a repetitive pattern. Accordingly, the alternating MD vorticity direction of the secondary flow of the jets from the staggered tubes in FIG. 3G results in shear layers which would align more fibers in the CD. From the foregoing, it is appreciated to those skilled in the art that the tubes arranged as a matrix of rows and columns in the diffuser block are provided either vertically or inclined and the rows or columns may be provided as staggered for enhancing fiber alignment FIG. 3H similarly shows a repetitive pair vorticity pattern illustrating, e.g., negatively oriented rows 98 and positively oriented rows 99.

Turning now to FIGS. 4A–4H and FIGS. 5A–5H, the effect of vorticity in the tubes of the headbox 10 on the flow is illustrated for the slice and the nozzle chamber 14. Here, analysis shows the effect of vorticity in the jets leaving the tubes in the tube bank and entering the converging zone of the headbox. The purpose of this study is to investigate the effect of vorticity at the tube bank on the free surface rectangular jet 30 at the slice 22. Two cases have been considered, case one with no vorticity and the second case with axial vorticity. These cases are shown in FIGS. 4A and 5 A, respectively.

Figure 4A:
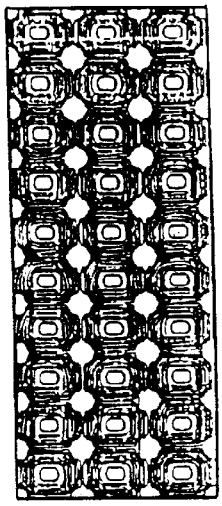
FIGS. 4A–4H illustrate stock flow irregularity associated with conventional paper forming machine headbox components.
Figure 4B:
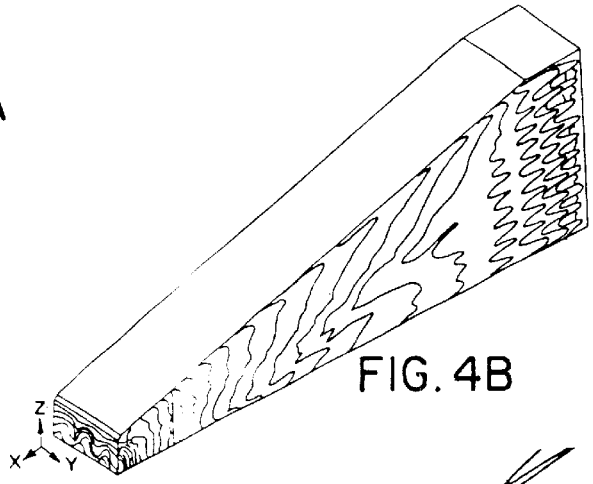

The tubes in these cases, i.e., case #1 (FIGS. 4A–4H) and case #2 (FIGS. 5A–5H) are arranged in vertical columns, as shown in FIGS. 4A and 5 A, respectively. The flow through the tube in case 1 has velocity component only in the machine direction. Wherein case 2, the flow in the tube has an axial vorticity imposed on the streamwise flow. The imposed secondary flows are counter-rotating axial vortices, that is the direction of rotation is clockwise and counter-clockwise in a checkerboard pattern. The cross machine direction, y, and the vertical z, components of the velocity at the tube outlet and the converging zone inlet are given respectively by:

$$v = \pm A\frac{2\pi}{\Delta y}\cos\frac{2\pi y}{\Delta y}\sin\frac{2\pi z}{\Delta z} \tag{1a}$$

and $$w = \pm A\frac{2\pi}{\Delta z}\cos\frac{2\pi z}{\Delta z}\sin\frac{2\pi y}{\Delta y} \tag{1b}$$

Figure 5A:
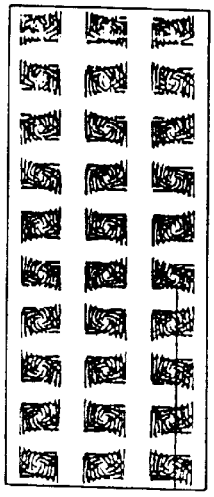
FIGS. 5A–5H illustrate the use of controlled axial vortices in the paper stock jets to provide more uniform paper stock flows in the nozzle chamber approaching the slice of the paper forming machine headbox component in accordance with the invention.
Figure 5B:
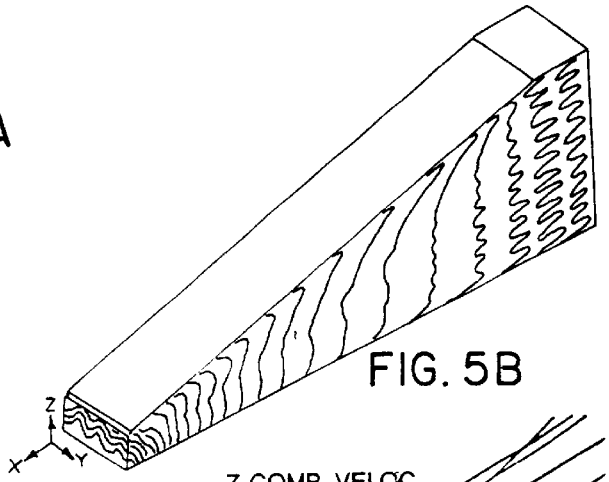

These velocity components are super-imposed on the streamwise velocity component of the jet leaving the tubes as shown in FIG. 5A. In equation (1*a*, 1*b*) w and v are the vertical (Z) and transverse (CD) components of velocity, A is the magnitude of the secondary flow at the inlet, $\Delta y$ and $\Delta z$ are the horizontal and vertical dimensions of the tube outlet, respectively. The magnitude A, of the super-imposed secondary eddy in this study is 1.5% of the average streamwise component. The secondary velocity profile at the inlet to the converging zone is defined by a 4th order function of the y and z coordinates. The Reynolds number, based on the average inflow velocity U, the vertical height of the headbox L, and the kinematic fluid viscosity, v; is given by:

$$Re = \frac{UL}{v} \tag{2}$$

The results of the two cases are described herein with the analysis of computational experiments. The flow characteristics at the slice for each case is given by presenting the contour plot of each of the three velocity components (see FIGS. 4C–4H and FIGS. 5C–5H). Since the direction of the secondary flows cannot be identified in the black and white reproduction of the color-coded plots, we have added arrows to the plots to distinguish the flow direction.

For the first case, where the tubes are arranged in a straight vertical column, the flow is periodic with a wavelength of one-third of the width of the computation domain. The vertical component of the flow plays an important role in transferring fluid of high streamwise momentum towards the bottom wall of the headbox. Due to the periodicity of the flow, this momentum transfer varies significantly in the CD direction. Where the vertical velocity towards the wall is larger, the faster moving fluid carried from the middle of the slice to the wall forms a liquid jet. Where the vertical velocity is relatively smaller, a streamwise velocity jet of lower speed appears. These liquid jets can be seen in FIGS. 4D, 4F and 4H, where the contour plot of the three velocity components for this case are plotted along a horizontal cross-sectional plane near the lower lip of the slice. Removing the average vertical velocity from the actual vertical velocity reveals the cellular pattern of the secondary flow structure. The secondary flow patterns at the slice for each of the two cases are illustrated in the contour plots. The contour plots of the average velocity components for cases 1 and 2 at a horizontal cross-sectional plane are shown in FIGS. 4D, 4F, 4H and FIGS. 5D, 5F and 5H, respectively.

Figure 4C:
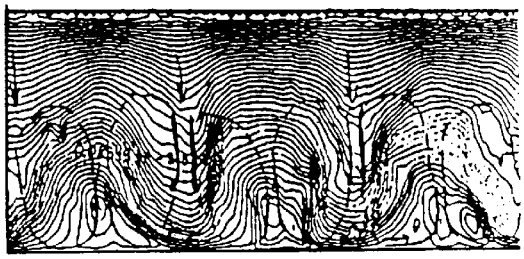
Figure 4D:
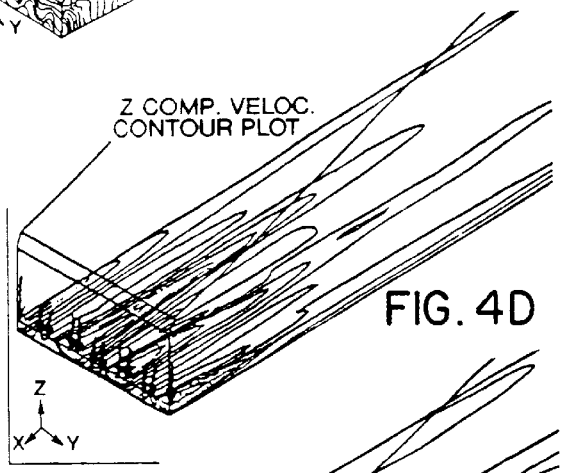
Figure 4E:
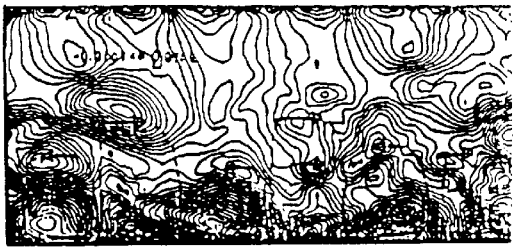
Figure 4F:
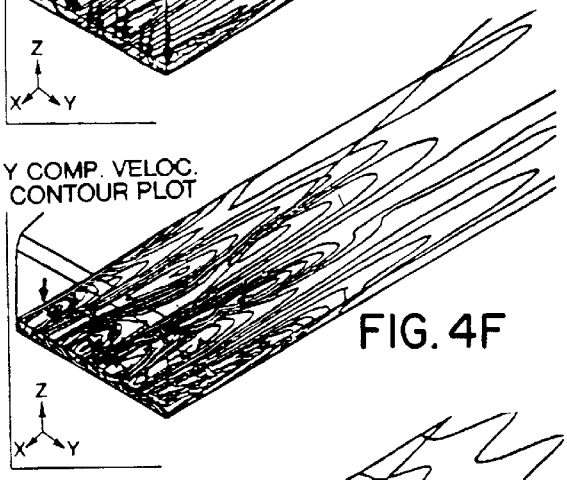
Figure 4G:
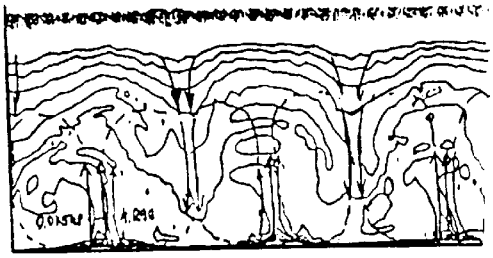
Figure 4H:
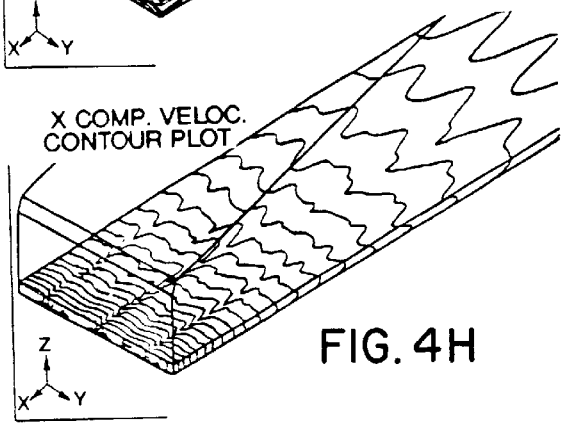
Figure 5C:
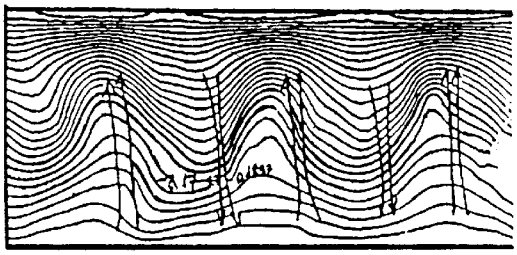
Figure 5D:
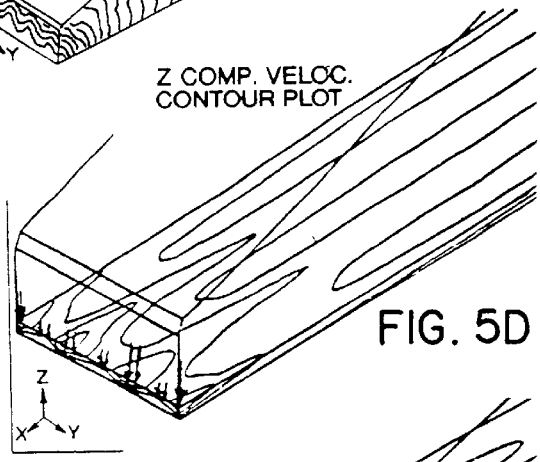
Figure 5E:
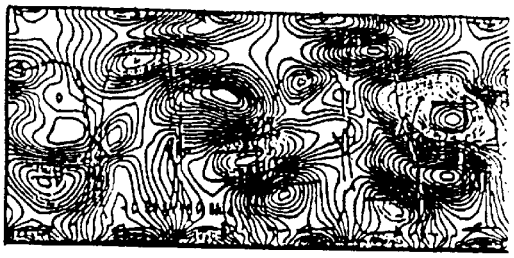
Figure 5F:
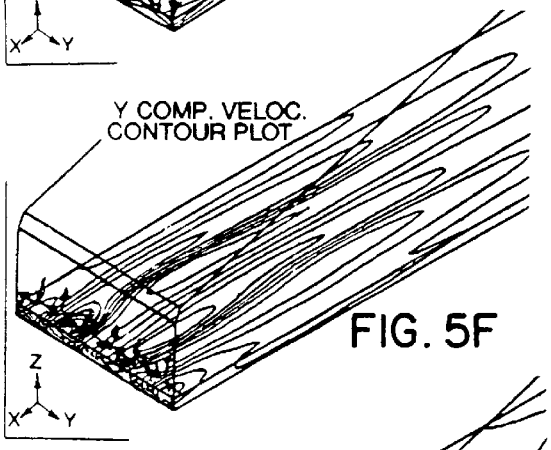
Figure 5G:
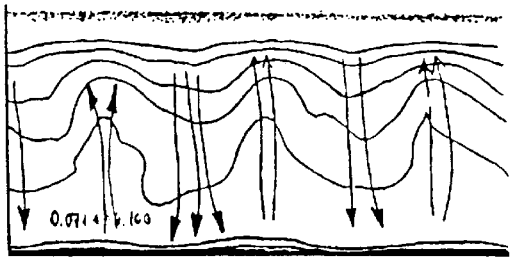
Figure 5H:
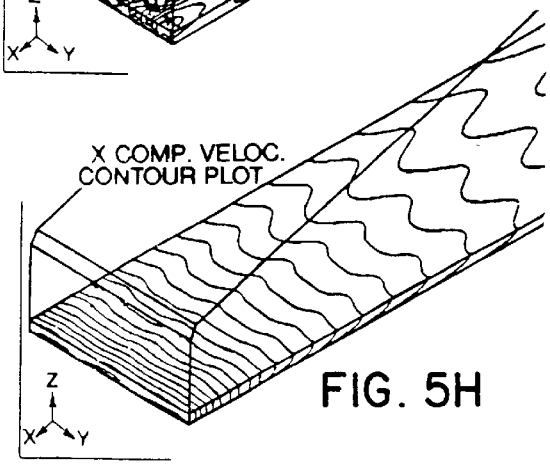

The vertical velocity component contour plot in FIGS. 4G, 4E and 4C show that the flow at the slice has a periodic structure similar to that in Case 1 (i.e., FIGS. 5G, 5E and 5C). However, in this case the deviation of the actual vertical velocity from the average vertical velocity is smaller. Consequently, less fluid with high streamwise momentum is transferred towards the bottom surface of the headbox. Also, less fluid with low streamwise momentum is lifted from the lower surface towards the middle of the slice. Thus, the secondary jets at the slice for Case 2, are weaker and less noticeable. Compared to Case 1, the secondary fluid flow cells created in this case are further away from the bottom and the CD velocity components are smaller than those of the first case.

In Case 1, the vertical velocity component changes sign and the variation in streamwise velocity due to the jets from the tubes remain strong up to the slice. As seen from the contour plot of the z component of velocity, there is considerable non-uniformity in the velocity. This kind of flow results in a streak pattern when manufacturing light-weight sheets. In the other case, however, the vertical component, as well as other components of the flow field, are more uniform due to the vortices which result in more effective coalescence and mixing of the jets.

The counter-rotating pattern of adjacent jets, as considered in this study, is perhaps not the most effective pattern for mixing of the fluid and suspended particles in jets from adjacent tubes. A more effective method for mixing is to force the jets from the tubes to rotate in the same direction. Depending on the desired properties of the sheet, the rotational pattern of the jets should be accordingly controlled using the special tubes outlined above and the specific pattern arrangement of FIGS. 3A, 3B or 3C, as appropriate.

In another embodiment, the vortex swirls are induced by means of pressure pulse generating elements. This method has three distinct advantages:

1) the generation of the secondary flow or swirl in the tubes can be fine-tuned on-line as the machine is in operation without any disturbances to the production,
2) the swirl number or the strength of the secondary flows can be adjusted in individual rows of tubes or in individual sections of the tube bank on-line while the machine is in operation without any disturbances to the paper machine production, and
3) no spiral finds or grooves or other constrictions are place inside the tubes; therefore, the probability of tube plugging is reduced below the conventional tubes.

Conventional tubes have two general sections. The first section is a small diameter tube which contacts at one end with the manifold or distributor of the headbox. On the other end, the small diameter tube connects to a larger diameter tube through a step change in cross-sectional area, as shown in FIG. 6.

Figure 6:
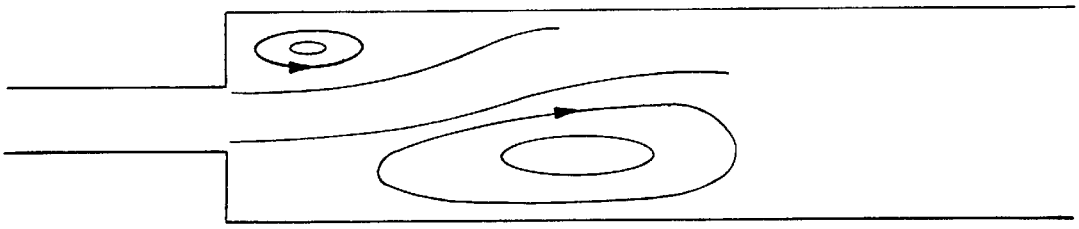
FIG. 6 is a side view cross-section of a tube in the tube bank of the headbox.

FIG. 6 shows a side-view cross section schematic of a tube in the tube bank of the headbox and the flow pattern from the small diameter tube at the left to the larger diameter tube. The doughnut shaped vortex is not axisymmetric since the jet from the small diameter tube bends randomly to attach to the wall of the large diameter tube. Often the jet changes angle in a random manner.

Figure 7A:
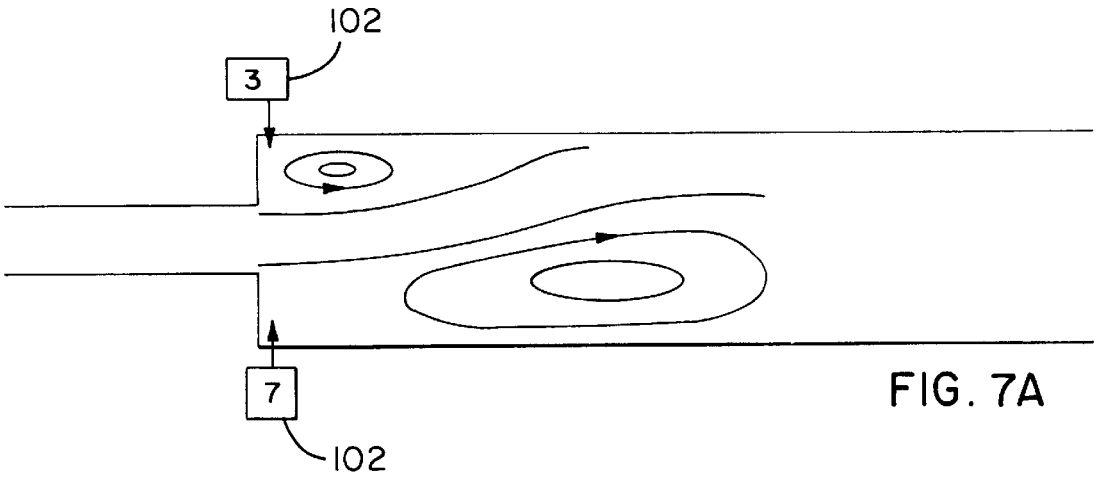
FIGS. 7A and 7B show the location of pressure pulse generators in one embodiment of the invention.
Figure 7B:
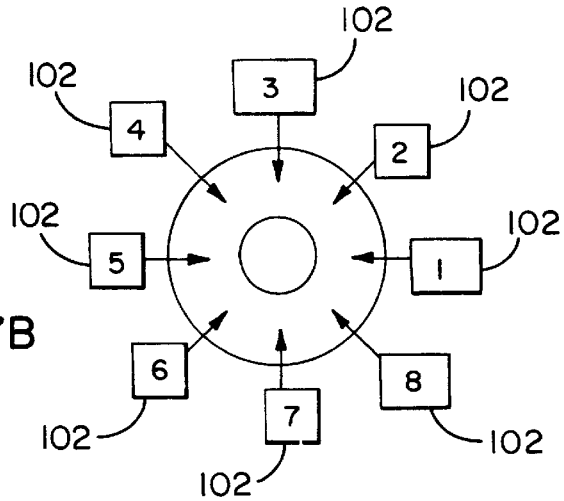

This embodiment provides a method and device to regulate the bending characteristics of the jet from the smaller diameter tube in order to generate a desired flow pattern at the outlet of the larger diameter tube. The described embodiment provides of a tube with a smaller diameter section followed by a step change or a more gradual change of diameter to a larger diameter tube—there are 2 to 12 pressure pulse generators 102 (PPG) at ports near the throat of the tube as shown in FIG. 7A. The pressure gradient pulses are generated in a given time sequence in order to control and regulate the bending of the jet from the smaller diameter tube. The schematic of this embodiment is shown in FIG. 7B. The device consists of several (8 ports are shown in FIG. 7B) PPG units which operate with an electric signal connected to an analog-to-digital converter (A/D) board and a digital processor (a computer).

The PPG can either be an acoustic device generating a pulse of acoustic pressure in the form of longitudinal waves inside the fluid or an electromagnetic device generating a magnetohydrodynamic (MH) pulse. The purpose of the pressure gradient pulse or the MH pulse is to control and guide the bending of the jet from the smaller diameter tube. Upon activation of a PPG, the jet can be forced to bend almost instantaneously in the direction opposite to the propagation of the pressure gradient pulse. For example, the activation of PPG at port 7 forces the jet to bend in the direction shown in that figure. If the PPG at ports 3 and 7 are activated in a time periodic manner, the jet oscillates back and forth in a time periodic manner. If PPG 1 to 8 are activated in a sequential manner (i.e., 1, 2, 3, . . . 8, 1,2, . . . ) the jet will rotate counter-clockwise with a slight phase lag. Activation of ports 8 to 1 will force the jet to rotate in the clockwise direction. Rotation of the jet around the larger diameter tube results in a swirling jet at the outlet of the tube. The swirl number, S, can be controlled with the frequency of activation of the PPG. Higher frequency will result in more swirl and larger swirl number, S.

It is important to note that the flow characteristics inside the tubes can be fully controlled with the sequence and the frequency of the activation of the PPG.

In a typical headbox, there are N tubes inside the tube bank where N could be several hundred to few thousand depending on the size of the headbox. The tubes are arranged in R number of rows, where 10>R23, and C=N/R columns.

With this embodiment each tube can be independently controlled, if desired. It is also easy to control blocks of tubes; for example, each row of tubes could have independent control, as well as, each column of tubes from column 1 to q and from Column C-q to C could be controlled, independently. The magnitude of q depends on how far from the side walls the tubes need to be controlled independently for superior control of the flow near the side wall and the edge of the headbox and the forming section.

Figure 8:
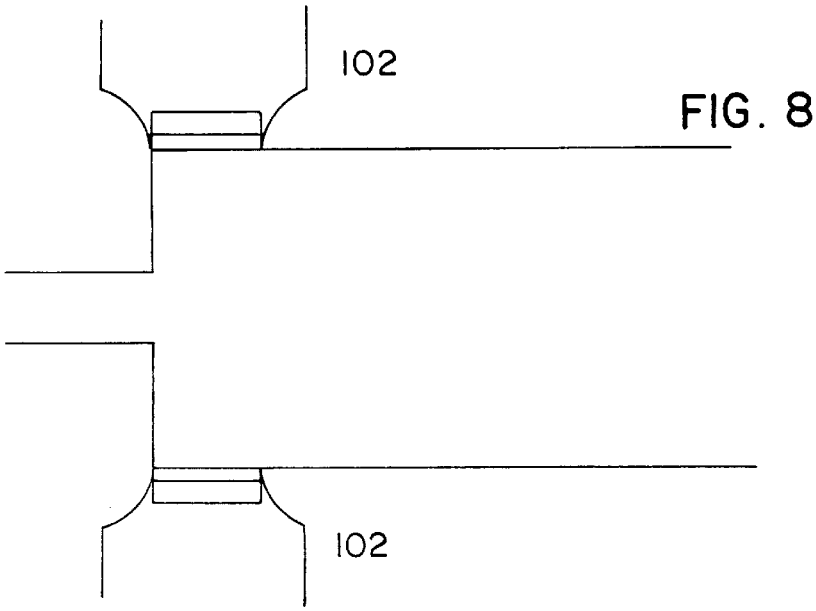
FIG. 8 is a cross-section view of a tube showing mounting details of an acoustic pressure pulse generator.

One form of a PPG consists of a small flat plate, up to a few millimeters in diameter and less than a millimeter thick, which is flush with the inner surface of the tube. The surface would oscillate generating longitudinal pressure gradient waves with the application of electric field to a piezoelectric crystal adjacent to it. The vibration of the surface generates an acoustic field which propagates into the fluid generating a longitudinal wave. The setup of the PPG in the port at the throat of the tube is illustrated in FIG. 8. Another PPG element may be provided in the form of a ring which is positioned flush with the interior surface of the curved outlet of the insert of the smaller diameter section of the tube. The ring-shaped PPG is activated locally in a circular manner. The angular location of activation generated a pressure disturbance which deflects the jet, as shown in the diagram, to one side. Continuous activation of the PPG element in a circular manner will force the jet to rotate around the curved surface of the insert generating a swirling motion of the fluid inside the larger diameter tube.

Figure 9:
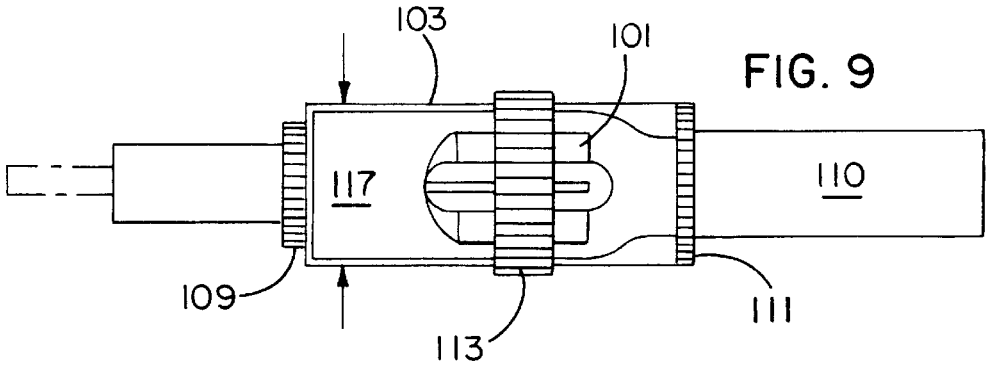
FIG. 9 is a cross-section view of a tube showing mounting details of a magnetically actuated finned body for generating vortexes.
Figure 10:
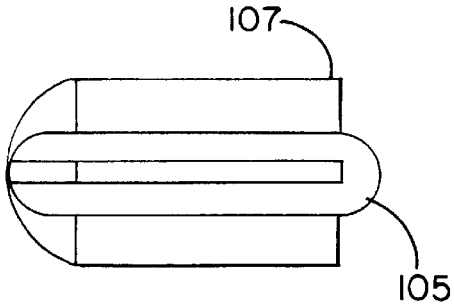
FIG. 10 is a side view and front view of the finned body shown in FIG. 9.
Figure 10A:
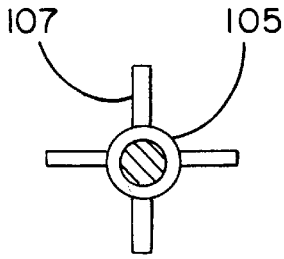
Figure 10B:
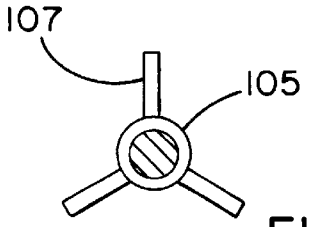
Figure 11:
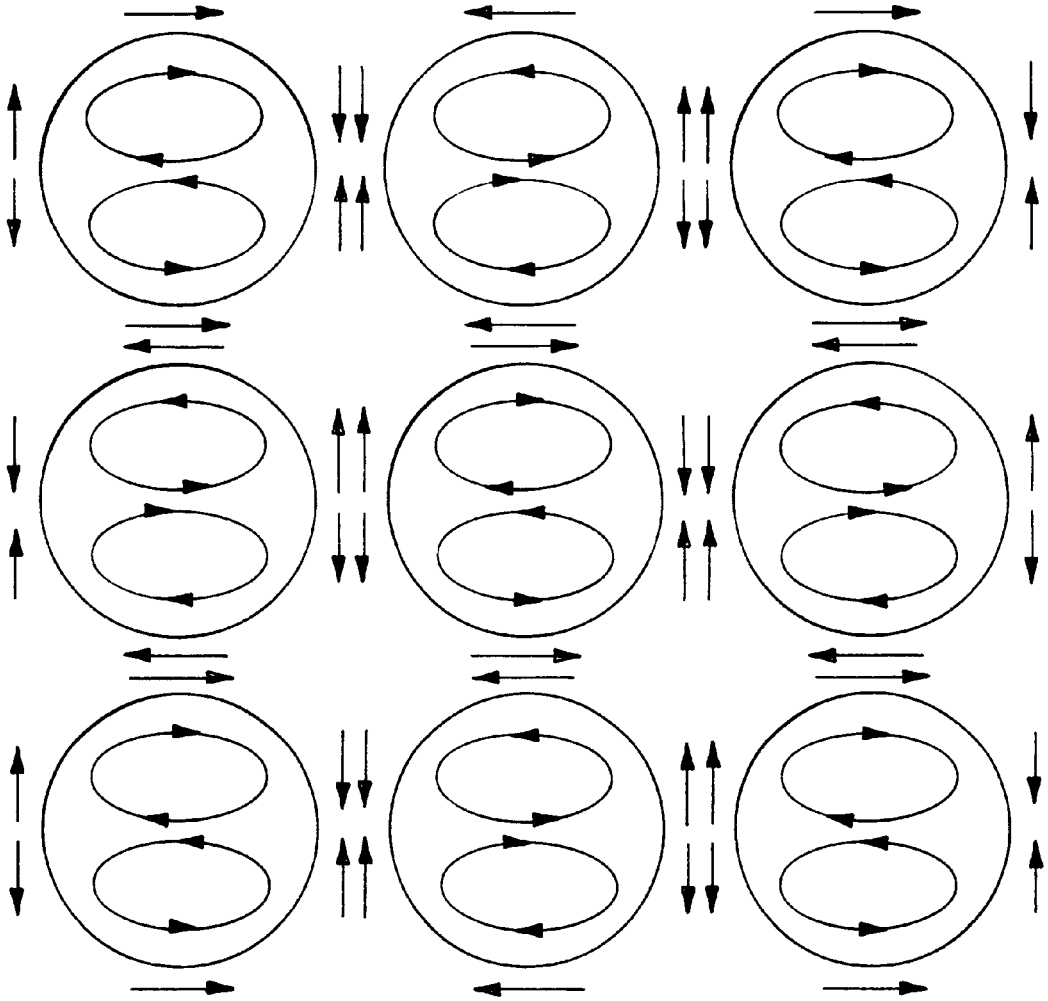
FIG. 11 shows a pair of counter-rotating vortices delivered from each tube in the block in an XY_+pattern.
Figure 12:
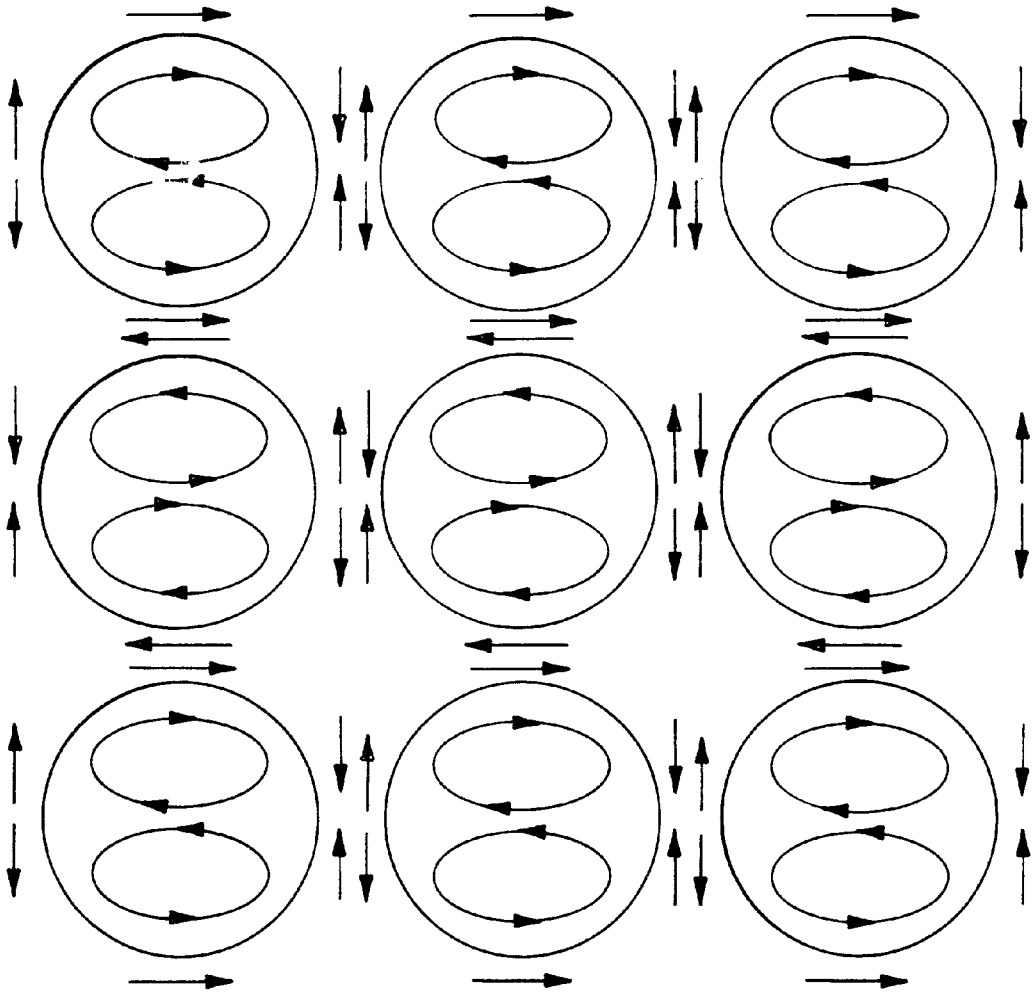
FIG. 12 shows a pair of counter-rotating vortices delivered from each tube in the block in an XX_+pattern.
Figure 13:
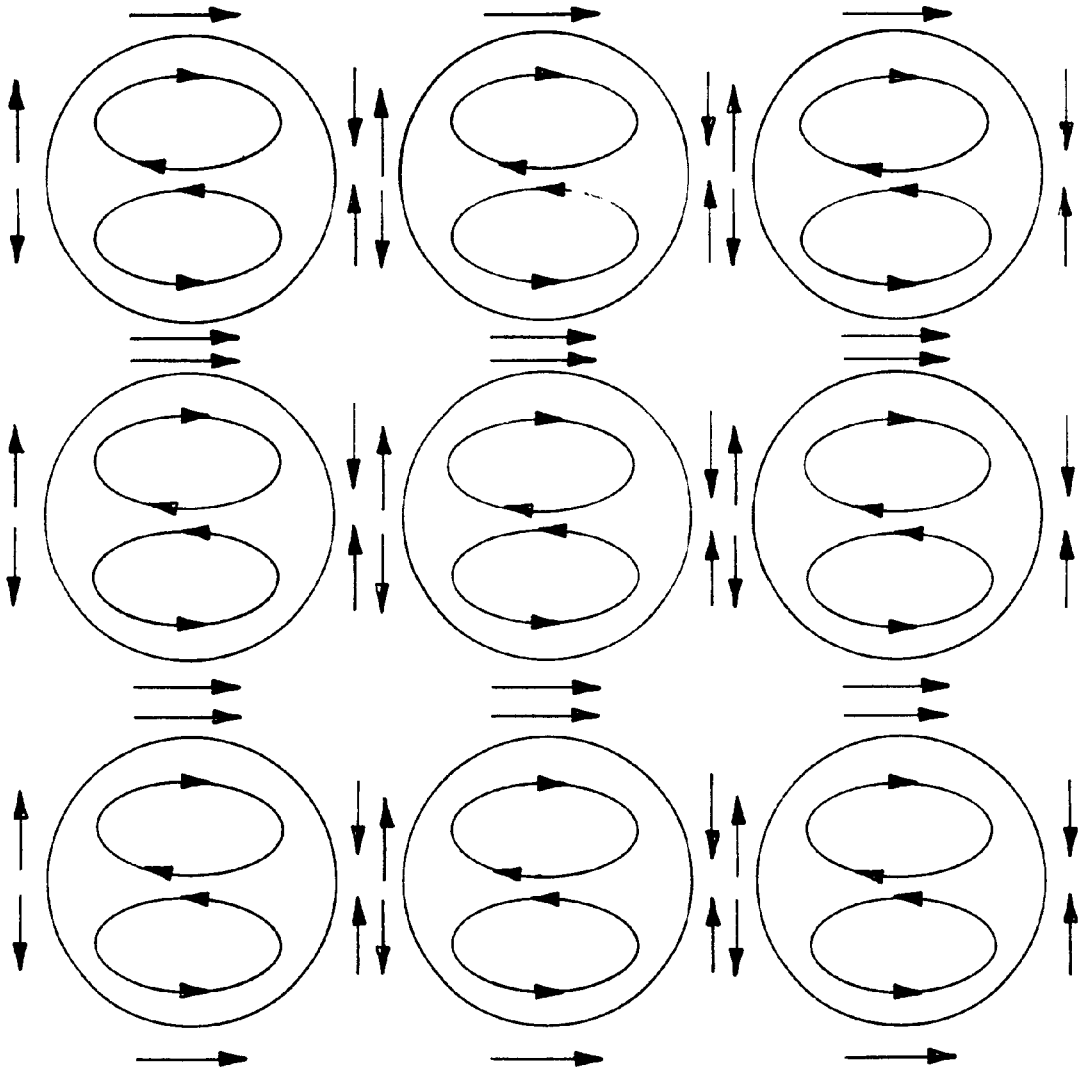
FIG. 13 shows a pair of counter-rotating vortices delivered from each tube in the block in an $XX_+$pattern.
Figure 14:
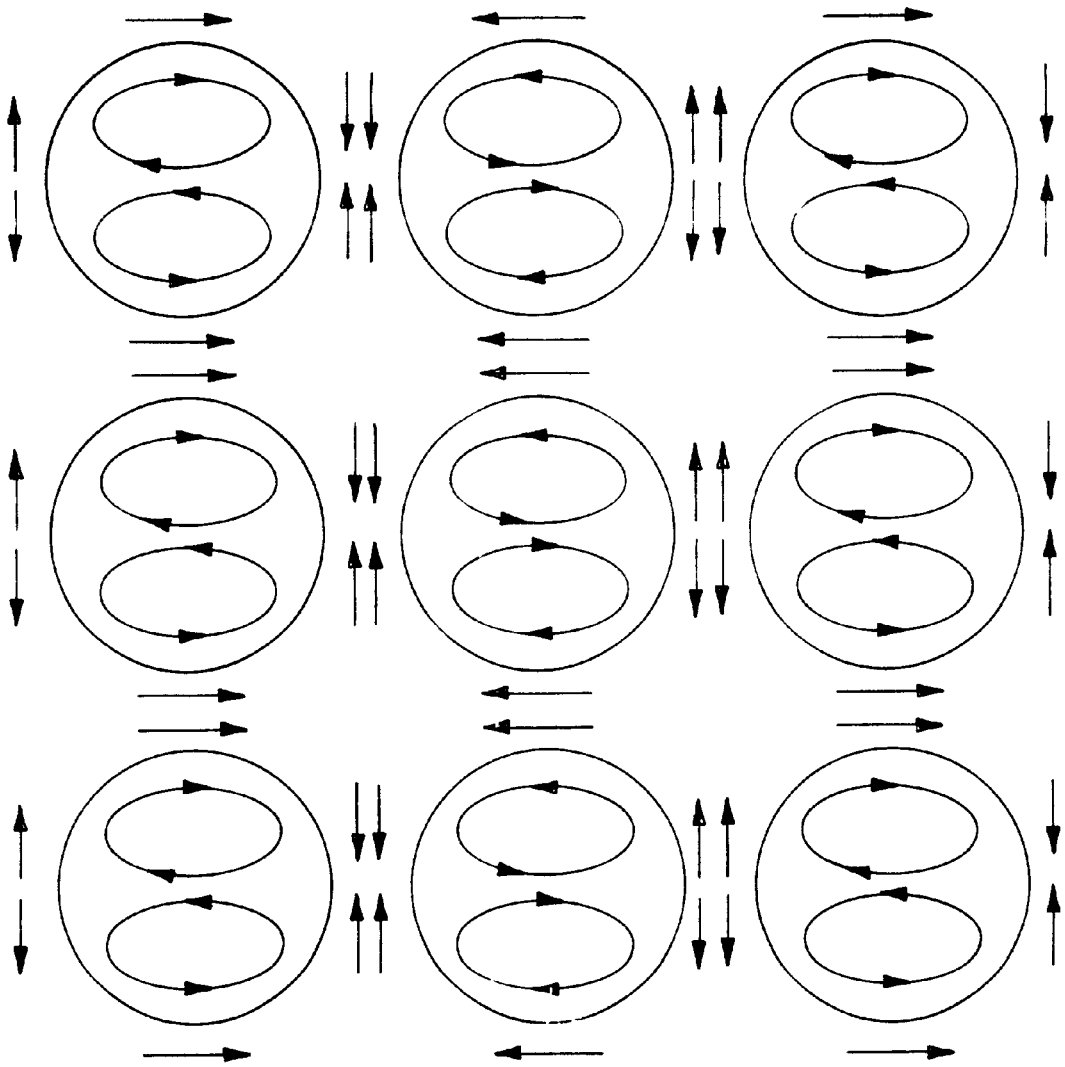
FIG. 14 shows a pair of counter-rotating vortices delivered from each tube in the block in an $XY_+$pattern.

A further mechanism to generate swirl inside the tubes in the tube bank of a headbox is by the use of magnetic force where a non-axisymmetric body of revolution 101 is placed inside an axisymmetric tube 103, as shown in FIG. 9. The metallic body of revolution 101 consists of an axisymmetric central region 105 (shown in FIG. 10) and one to twelve fins. The most practical system would have three (F-3) to four (F-4) fins, as shown in FIG. 10. The fins could be straight or spiral shaped. The central body of revolution 101 is partially hollow and consists of metallic sections or poles. The overall float is designed to experience up to three components of magnetic force, F1, F2 and F3 and one component of torque, T1, from the magnetic rings 109, 111 and 113. Two of the three components of force consist of axial forces in opposite direction from magnetic rings 109 and 111. The third component of force is a radial magnetic force from the electromagnetic ring 113, which holds the "float" in the center of the 117 section of the tube. The electromagnetic ring 113 also exerts a torque, T. on the "float". The two opposing axial forces and the radial force from electromagnetic ring 113 hold the "float" in the center of the tube section 115. The torque from the electromagnetic ring 113 forces the "float" to rotate at a specific rate of rotation. The torque from the electromagnetic ring is variable according to the power supplied to the magnetic coil.

There are also hydrodynamic forces on the "float" during operation which resist the motion of the "float". The hydrodynamic forces are the normal stress (force per unit area normal to the surface of the "float") and the tangential stress (shear stress at the surface or drag per unit surface area). The magnetic forces and torque are adjusted considering the hydrodynamic forces to keep the "float" at the center with the float rotating at a specific rate of rotation (usually between 5 to 100 cycles per second or Hz).

The rotation of the "float" inside section 117 generates a swirling flow inside the tube which persists into section 110 and further downstream through the outlet of the tube into the converging zone of the headbox. The amount of swirl can be adjusted by the amount of torque exerted on the "float" by electromagnetic ring 113. The faster the rate of rotation of the "float", the higher the swirl number inside the tube. The magnetic strength of the electromagnetic ring 113 can be adjusted on-line during operation to control the amount of swirl in individual tubes. Therefore, this method allows a fully automatic method to easily control the amount of swirl in individual tubes during operation attaching the electromagnetic ring 113, of each of the tubes to an electronic control system. An alternate mechanism may employ fins extended from the solid ring as a "rotor", which fits inside the tube. The ring is forced to rotate at a controlled angular speed by a magnetic field, such as the electromagnetic ring or other means. The same effect of generating a swirling flow inside the tube is obtained with this device.

In another alternate embodiment, the generation one or more counter-rotating vortex pairs (CVPs) may be set up inside each tube instead of a single vortex per tube. The counter-rotating vortices inside the tubes result in more effective interaction of the jets once leaving the tubes. The CVPs may be generated in four orientations in the tube block, as demonstrated in FIGS. 11 through 14. Only the secondary flow pattern, that is the flow in the cross-sectional plane of the tubes is shown in these figures. These figures show three rows and three columns of the tubes in the tube block. As shown in these figures, the manner by which the secondary flows in the jet interact depend on the secondary flow pattern formed in the collection of tubes in the tube block.

The interaction of the adjacent jets from the tubes in the tube bank result in higher level of shear and extensional flow perpendicular to the streamwise direction in the converging nozzle of the headbox. This results in a more uniform fiber orientation in the forming jet leaving the headbox. That is with the correct level of axial vorticity in the jets leaving the tubes, the interaction between the jets will be such as to prevent fiber orientation in the streamwise direction. This results in an isotropical fiber orientation at the forming jet leaving the slice of the headbox.

When the orientation of the CVPs in each adjacent tube in a row varies alternatively, then the pattern is designated as an XY form. Otherwise, if the orientation of secondary flows in each tube in the row is the same, the pattern is identified as the XX pattern. To identify the secondary flow patterns that change alternatively in adjacent tubes in a column, the symbol ± is used; otherwise when the orientation is same in each column, the pattern is symbolized with the $_{+}^{+}$notation. By comparing the patterns in FIGS. 11 through 14, one can see the difference between the manner by which the secondary flows interact; in other words, the different form the adjacent jets from the tubes in the tube block interact To explain the form of interaction between the jets in the tube block, let us define a cylindrical polar coordinate system (r,θ,z), to define the radial, azimuthal, and axial directions of flow in the tubes with respective velocity components ($u_r$, $u_\theta$,$u_2$). The primary flow is represented by the axial velocity component, $u_2$, where the other two components in the radial and azimuthal directions are referred to as the secondary part of the mean flow.

One mechanism to generate the CVP is based on the natural tendency of jets to form vortices when encountering a pressure gradient in the radial and azimuthal directions. From now on, we will refer to this variation in pressure as the Radial-Azimuthal-Pressure Variation (RAPV). Variation in pressure according to RAPV will result in CVPs with swirl number, S, defined for each vortex as $$S = \frac{\int_0^R r^2 uw\,dr}{R\int_0^R r\left(u^2 - \frac{1}{2}w^2\right)dr}$$

Note that the limit on the integrals is from the center of the vortex, r=0, to the edge at r=R. If the vortex is not circular, then R is a function of the angle, θ. When the swirl number is less than about 0.4, the value of S can be estimated by $$S = \frac{\gamma/2}{1-(\gamma/2)^2}$$

when $\gamma<0.4$ and $$S = \frac{\gamma/2}{1-\gamma/2}$$

when $\gamma>0.4$, where $\gamma$is the ratio of the maximum azimuthal to axial velocity. In this application, the value of S is between 0.01 for very weak swirl to 5.0 for very strong swirl in the flow, depending on the degree of shear and turbulence desired in the flow field. For various grades of paper, for example, the value of swirl may be changed through this range as outlined below.

Figure 15:
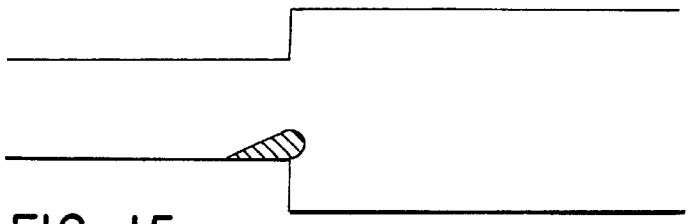
FIG. 15 shows the delta shaped block placed at the exit section of the small diameter tube.
Figure 15A:
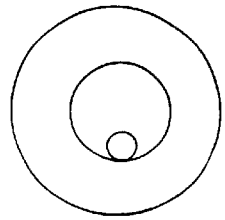
Figure 16:
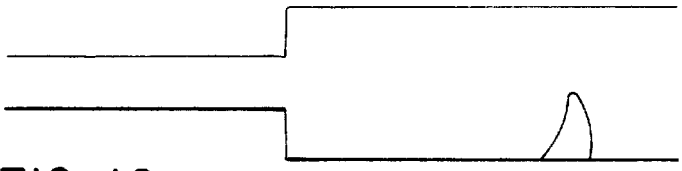
FIG. 16 shows the delta shaped block placed at the mid-section of the large diameter tube.
Figure 16A:
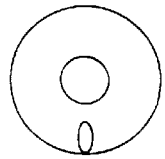
Figure 17:
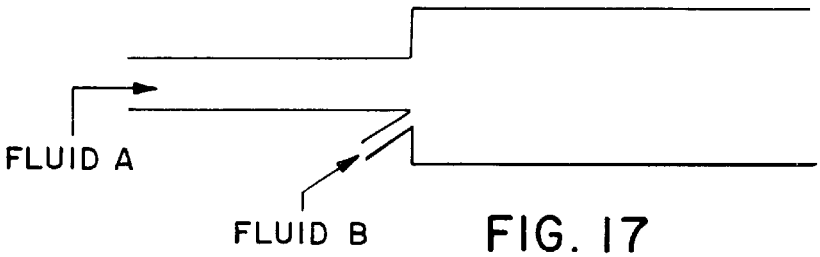
FIG. 17 shows the jet of Fluid B impinging on the Fluid A jet leaving the small diameter tube resulting in jet breakup into a CVP.
Figure 17A:
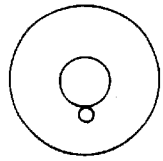
Figure 18:
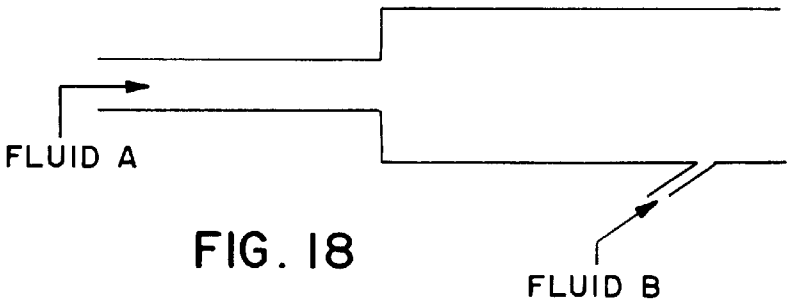
FIG. 18 shows the jet of Fluid B impinging on the Fluid A mainstream flow in the larger diameter tube resulting in a CVP.
Figure 18A:
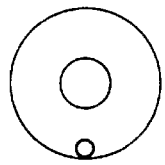

There are several mechanisms by which the RAPV can be generated in a jet. The first is due to the hairpin vortex forming in the wake of a protuberance in the jet, as shown in FIGS. 15 and 16. The protuberance in these figures is placed at the exit of the small diameter tube or after the expansion in the larger diameter tube. As the flow approaches the base of the protuberance, a streamwise velocity gradient forms resulting in a rolling flow towards the base of the protuberance. Depending on the shape of the protuberance, a standing vortex may or may not exist at the upstream base. The rolling vortex then bends around the protuberance and is swept upward with the flow forming a horseshoe-like vortex. The upward motion of the fluid splits the jet generating a CVP in the wake of the protuberance. This action can also be generated with a jet of a second fluid impinging at an angle on the primary jet from the small diameter tube or the flow inside the larger diameter tube as shown in FIGS. 17 and 18, respectively. The primary flow consists of Fluid A which is the fiber suspension. The second fluid, that is Fluid B, is used for generation of the CVP in the mainstream through interaction with the primary flow. This interaction could either take place at the outlet of the smaller diameter tube or further downstream inside the larger diameter tube.

Further enhancement of the tube design is to separate the outlet region of each tube into two sections such that each vortex in the CVP will enter one subdivided tube. Then in FIGS. 11 to 14, there will be 18 distinct outlet regions from 9 tubes in three rows and three columns.

Figure 19:
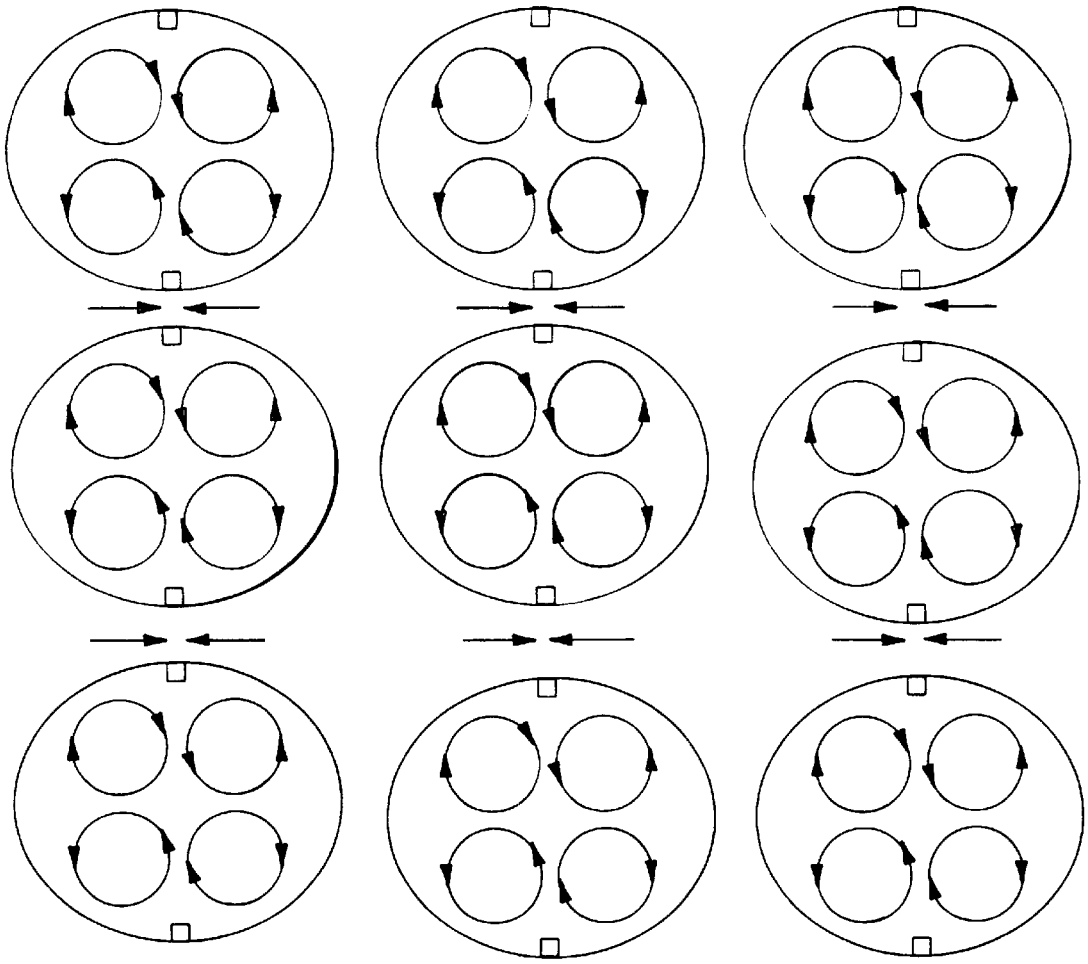
FIG. 19 shows two pairs of counter-rotating vortices in each tube arranged in XX pattern, the two small squares inside the tubes representing the general location of the protuberance.
Figure 20:
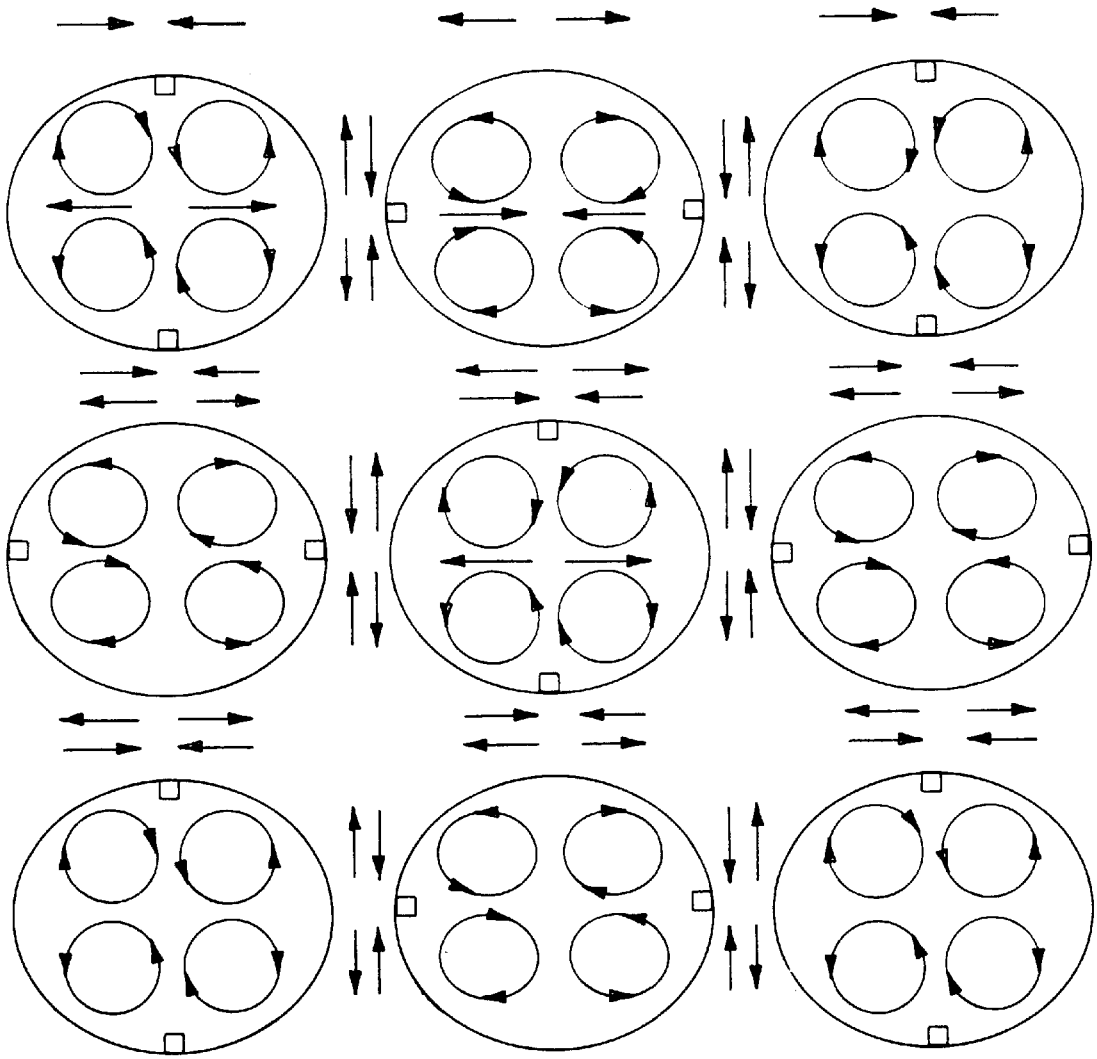
FIG. 20 shows two pairs of counter-rotating vortices in each tube arranged in XY pattern, the two small squares inside the tubes representing the general location of the protuberance.

It is important to note that the vortex patterns in FIGS. 11 to 14 are generated with one protuberance inside the tube, and that two protuberances at 180° apart, will generate two pairs of CVPs, as shown in FIGS. 19 and 20; and . . . N protuberances at 360°/N apart will generate N CVPs. It is also possible to place the protuberances at unequal angular position.

The consequence and benefits of generating axial vorticity inside individual tubes in the tube block of a headbox provides one or more counter-rotating vortex pairs (CVP) inside each tube instead of just one vortex per tube. The counter-rotating vortices inside the tubes result in more effective interaction of the jets once leaving the tubes. Depending on the application, the CVPs are generated in four orientations in the tube block, as demonstrated in FIGS. 11 to 14, as discussed above.

Figure 21:
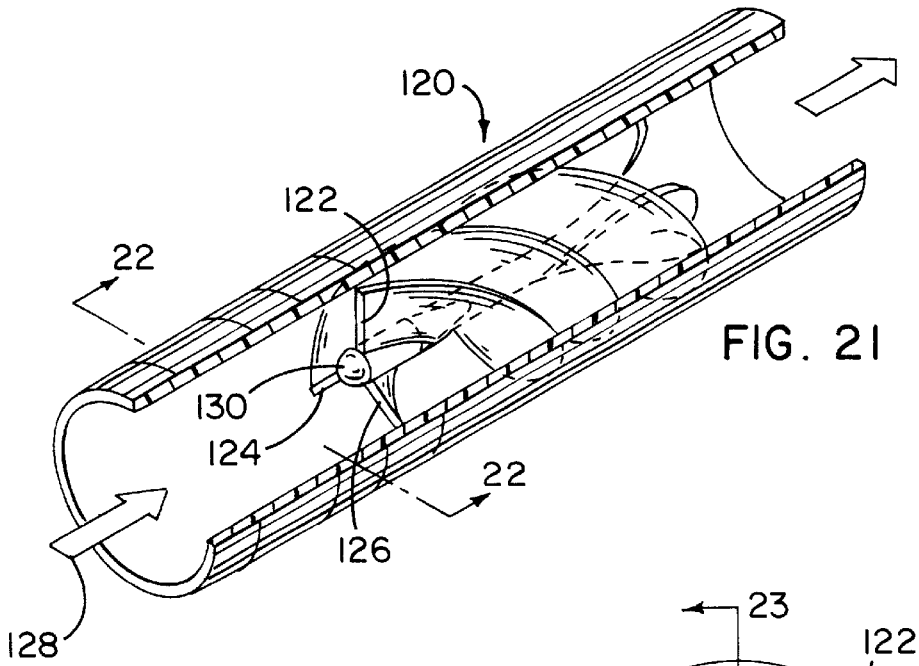
FIG. 21 is a perspective view of a small diameter tube design in accordance with the invention.
Figure 22:
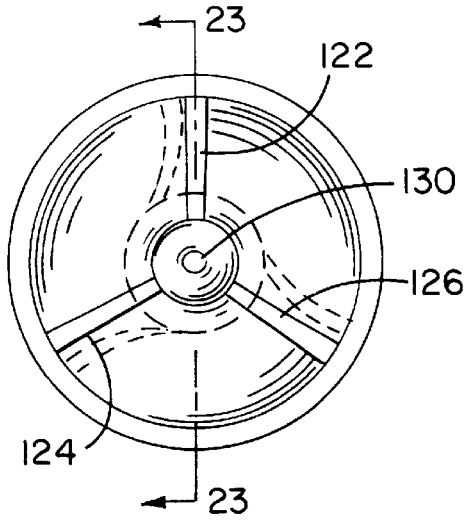
FIG. 22 is an end view of the tube showing the closed core and tube fins of the tube of FIG. 21.
Figure 23:
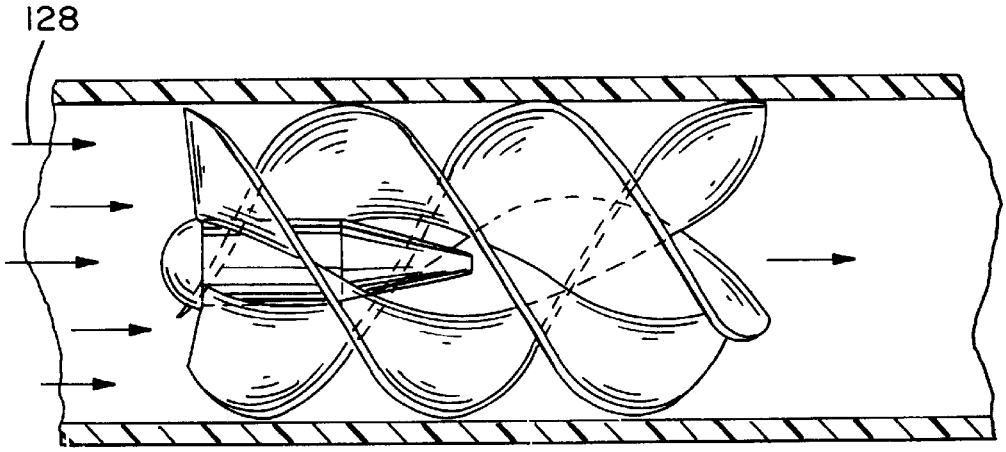
FIG. 23 is a sectional view of the tube of FIG. 21 taken as a cross section from FIG. 22.
Figure 24:
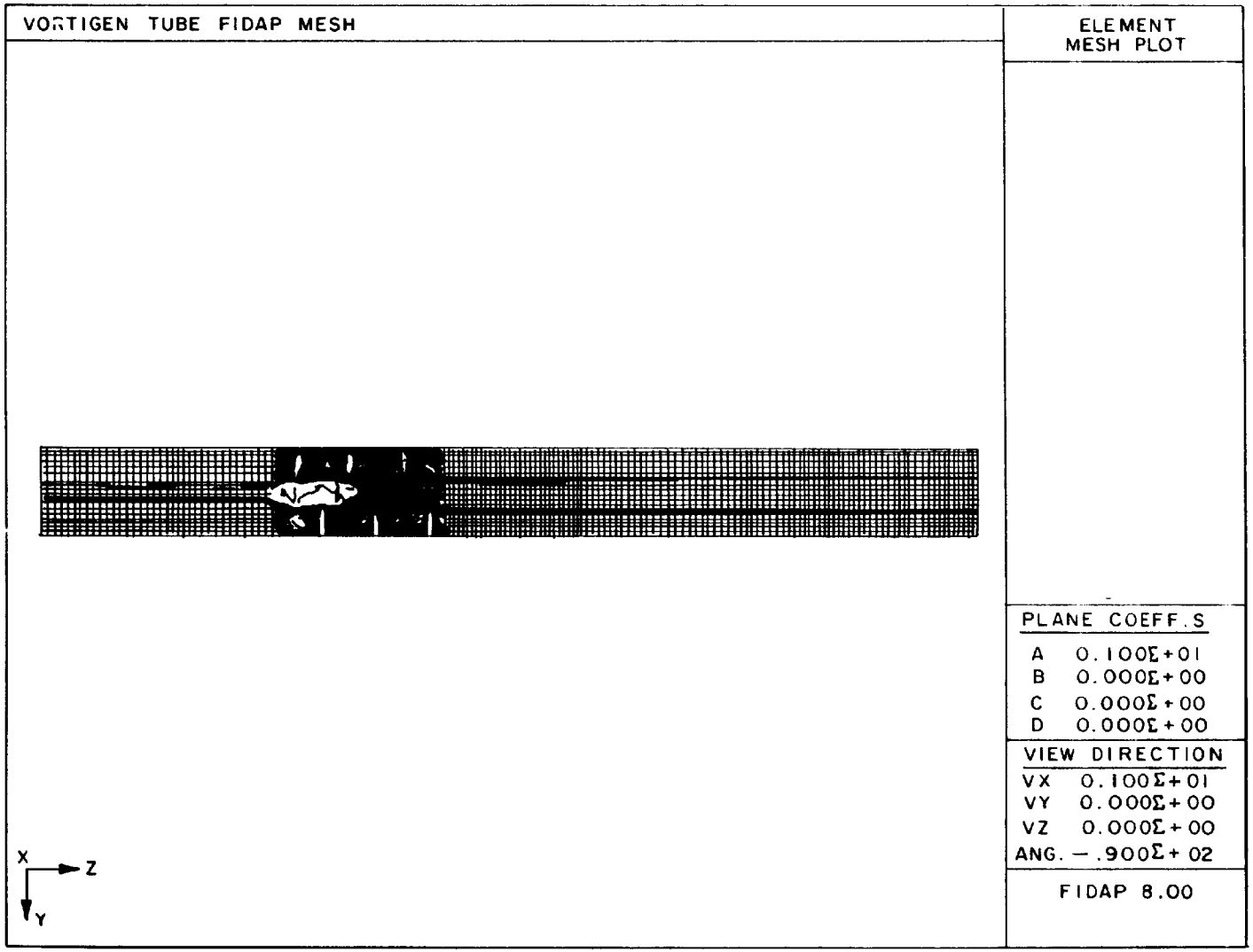
FIG. 24 is a plot of the mesh.
Figure 25:
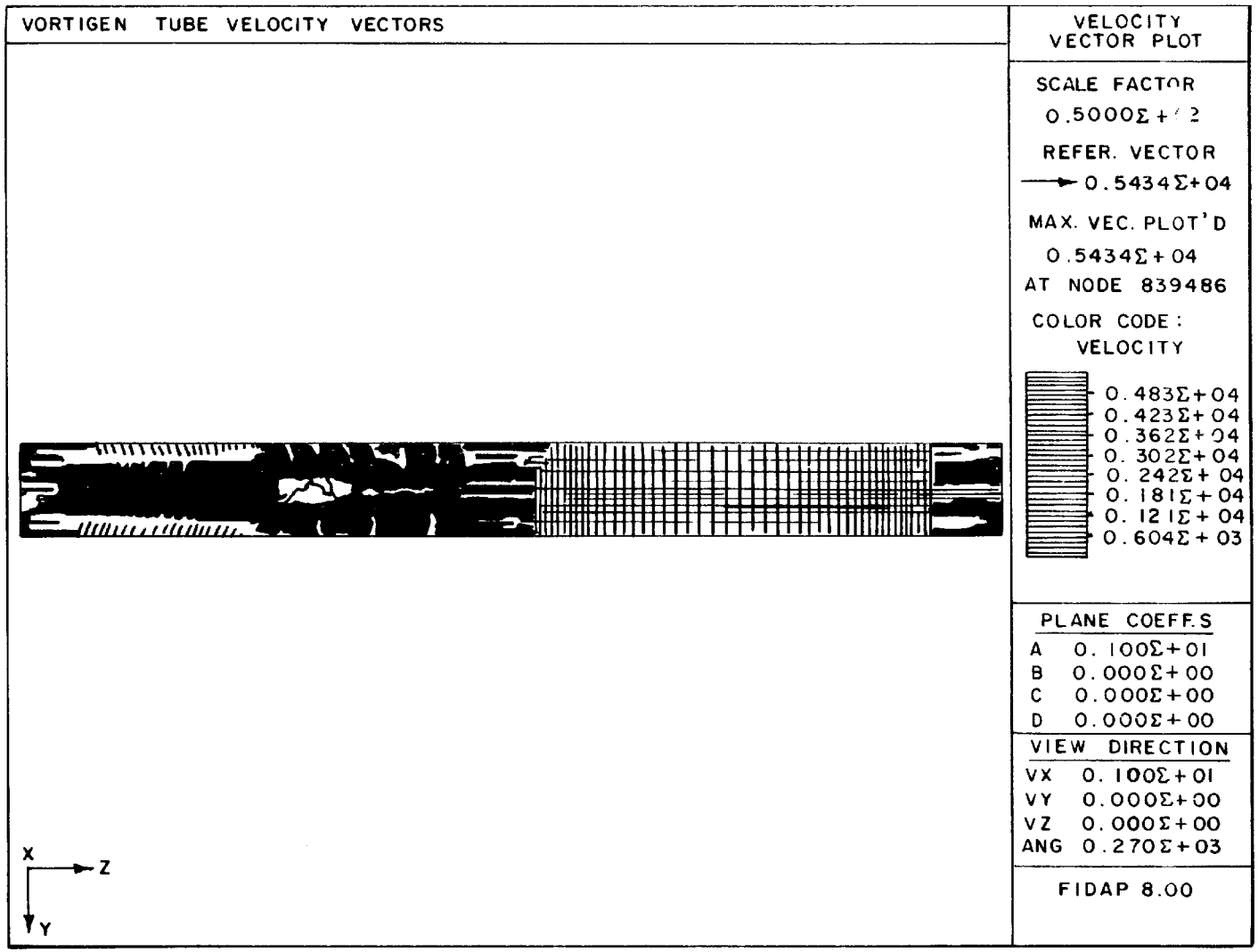
FIG. 25 shows velocity vectors on the center plane for the entire model.
Figure 26:
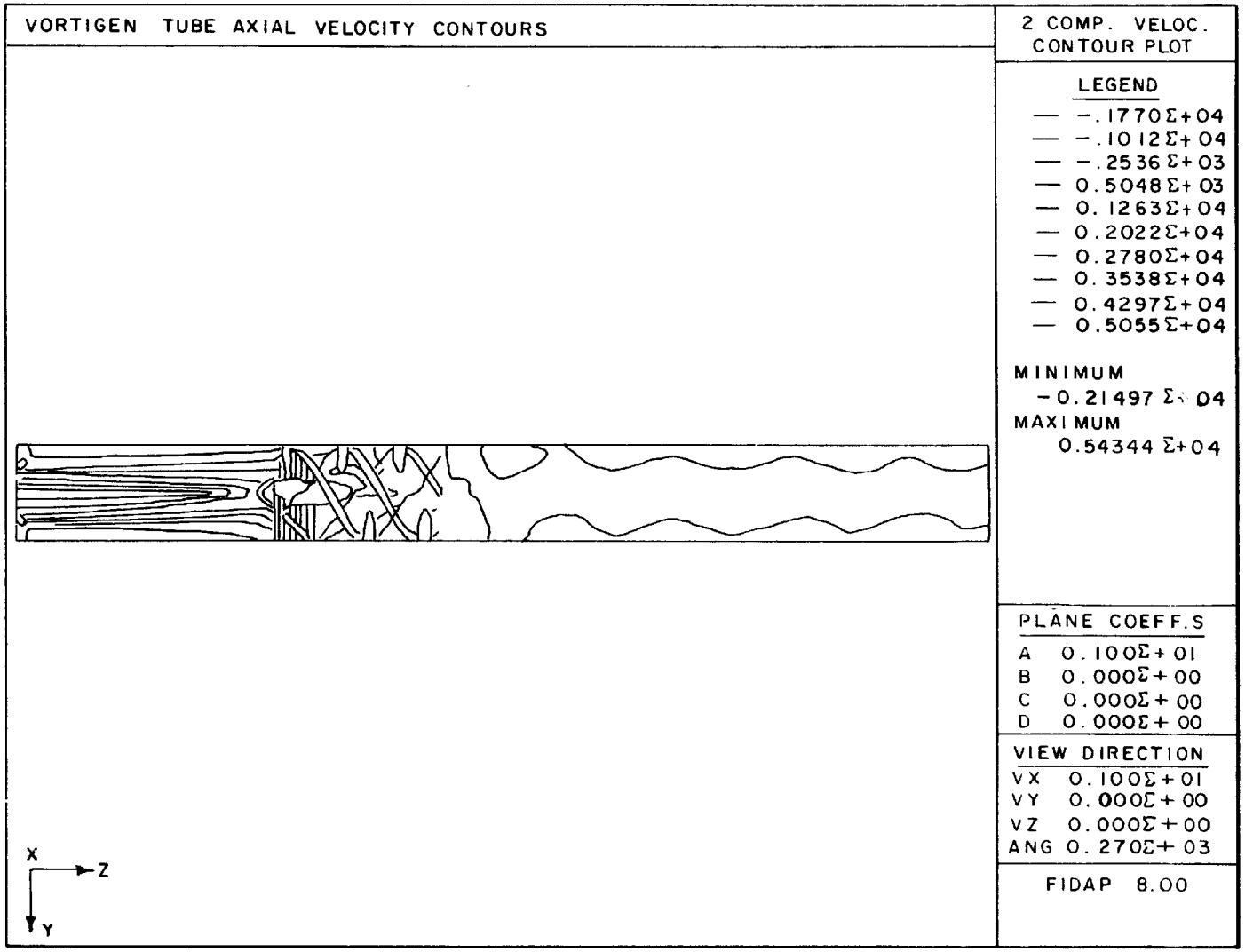
FIG. 26 shows axial velocity contours on the center plane for the entire model.
Figure 27:
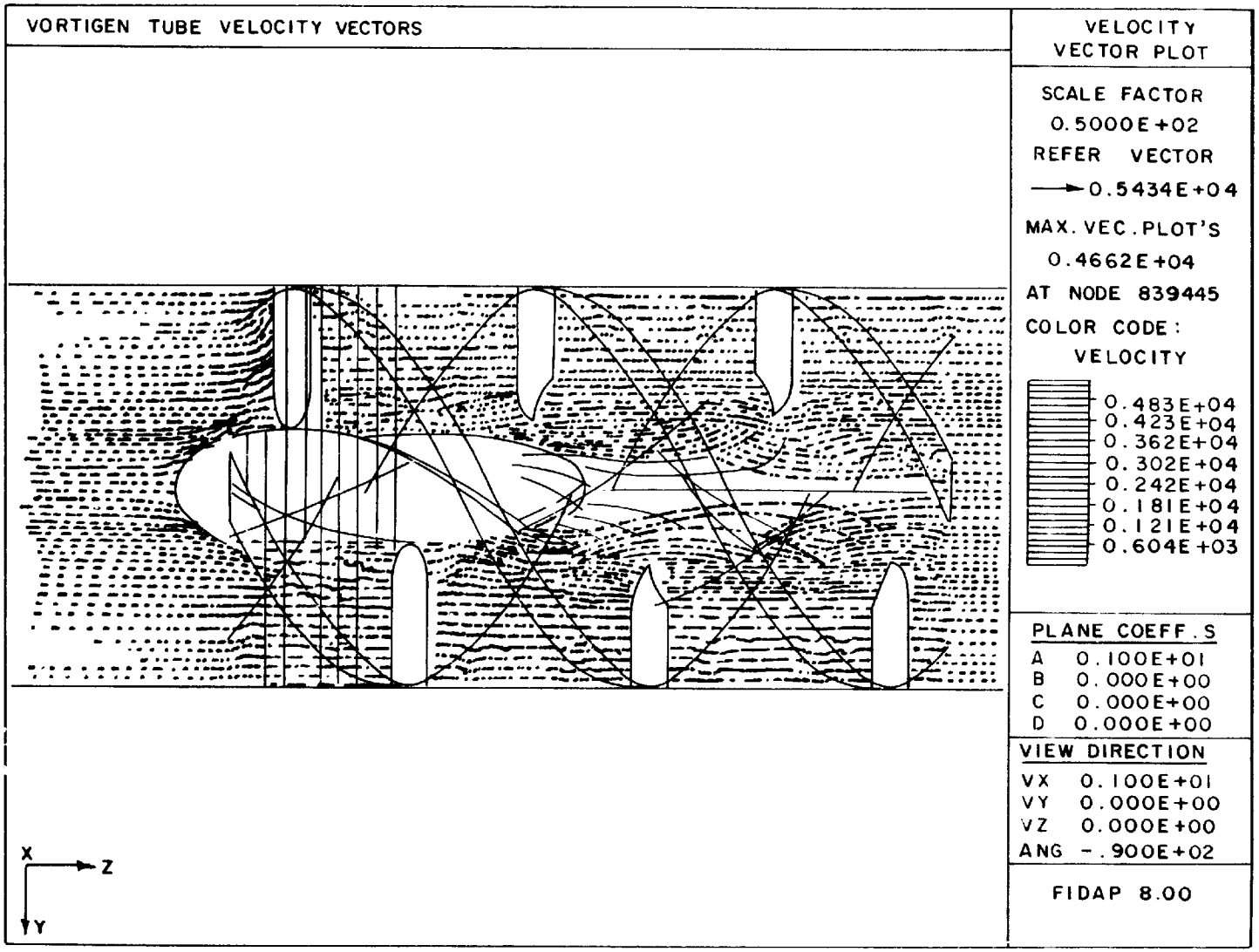
FIG. 27 shows velocity vectors on the center plane for the fin section only.
Figure 28:
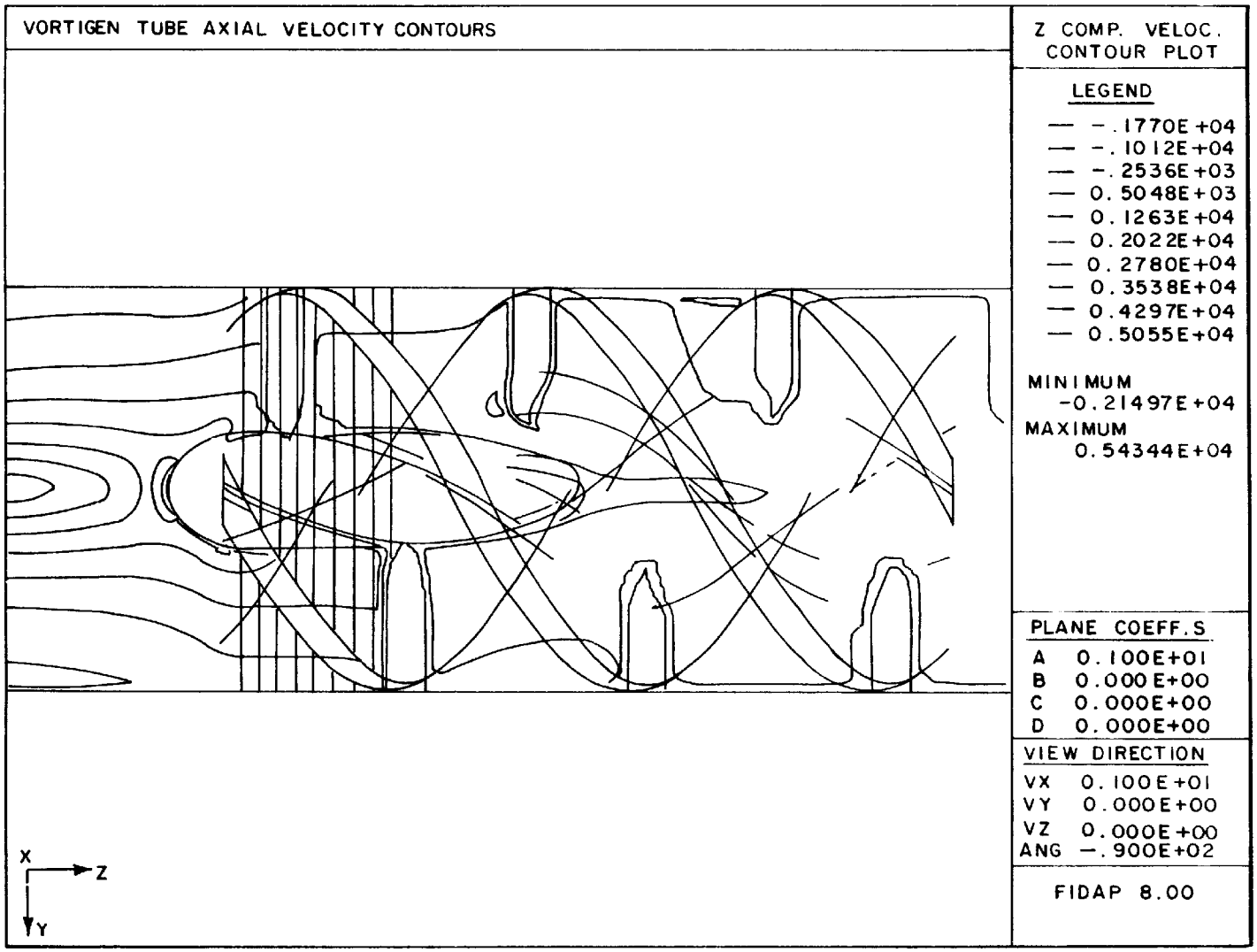
FIG. 28 shows axial velocity contours on the center plane for the fin section only.
Figure 29A:
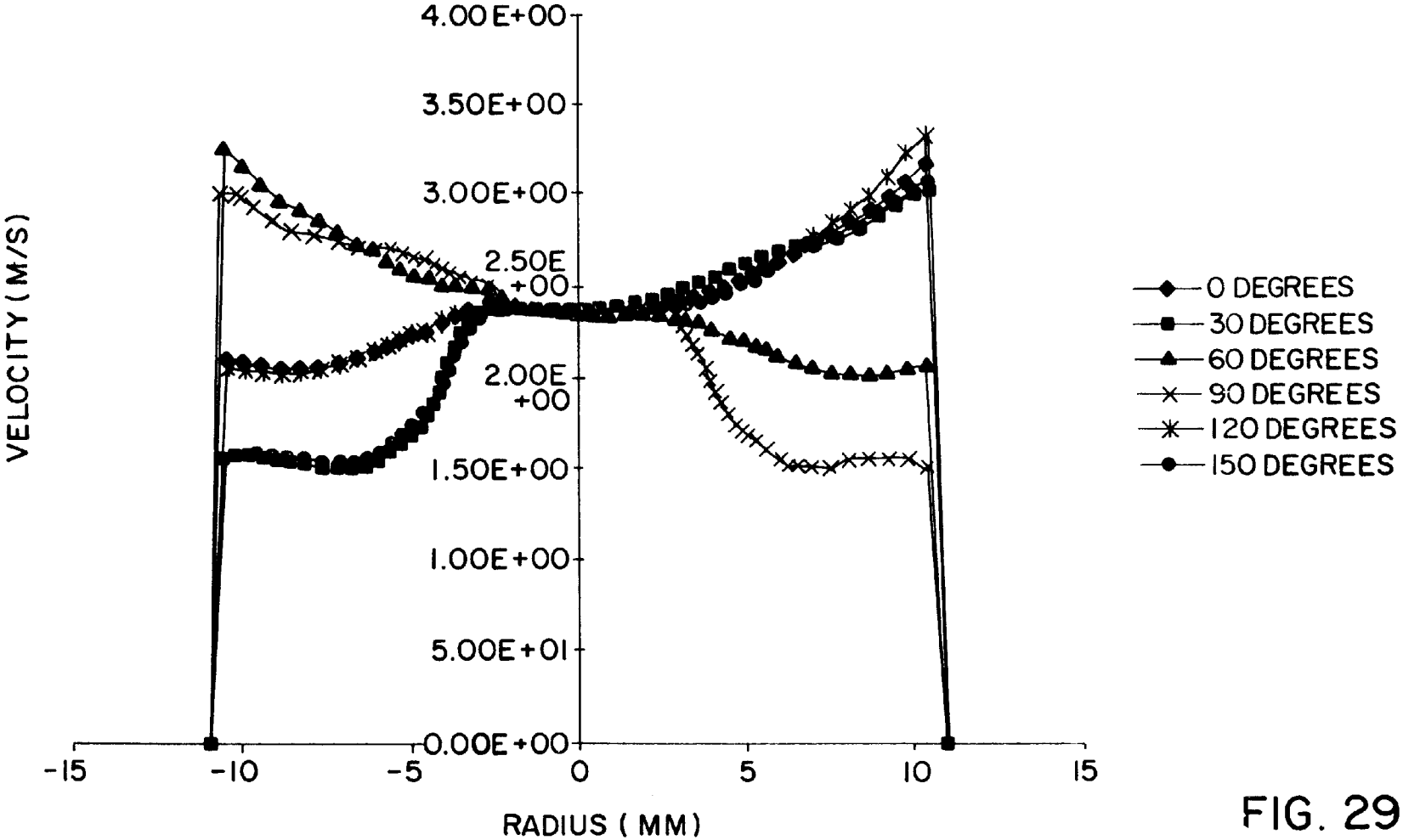
FIG. 29A is an Excel plot showing axial velocity plotted at varying angles 5 mm past the end of the fins.
Figure 29B:
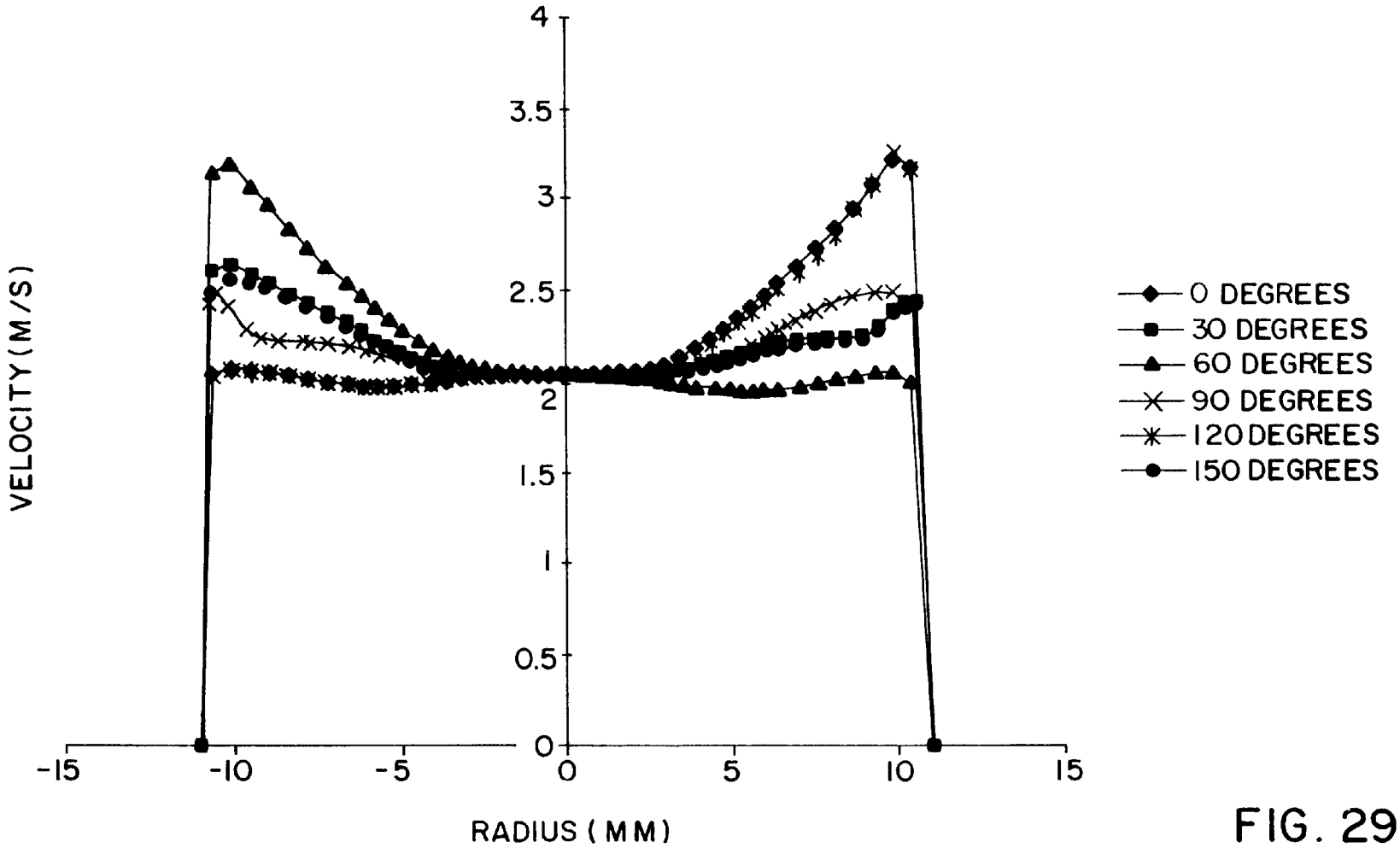
FIG. 29B shows the same at one diameter past the fins.
Figure 30A:
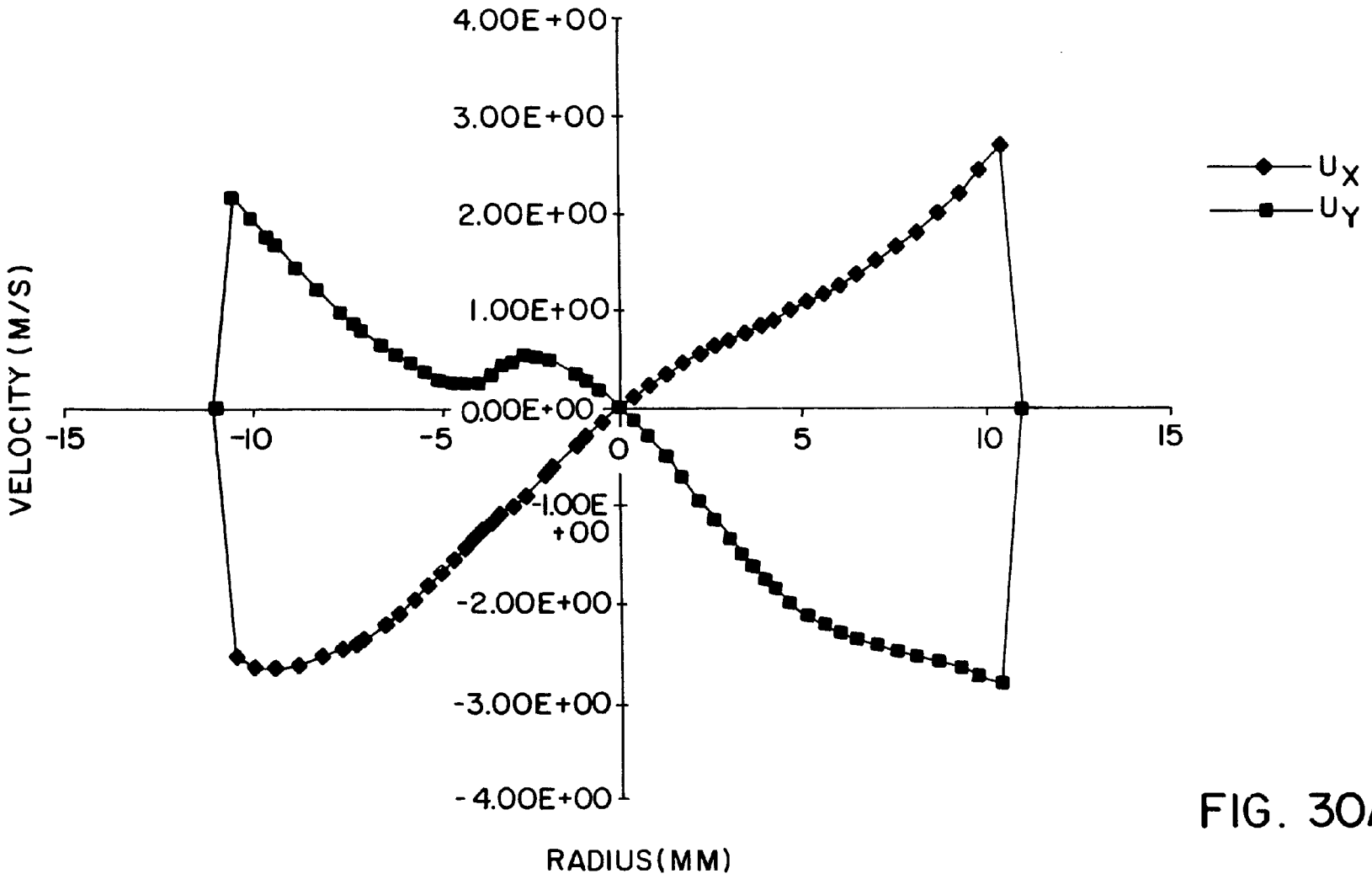
FIG. 30A shows the components of swirl taken along a line 45 degrees to the coordinate axes 5 mm past the end of the fins.
Figure 30B:
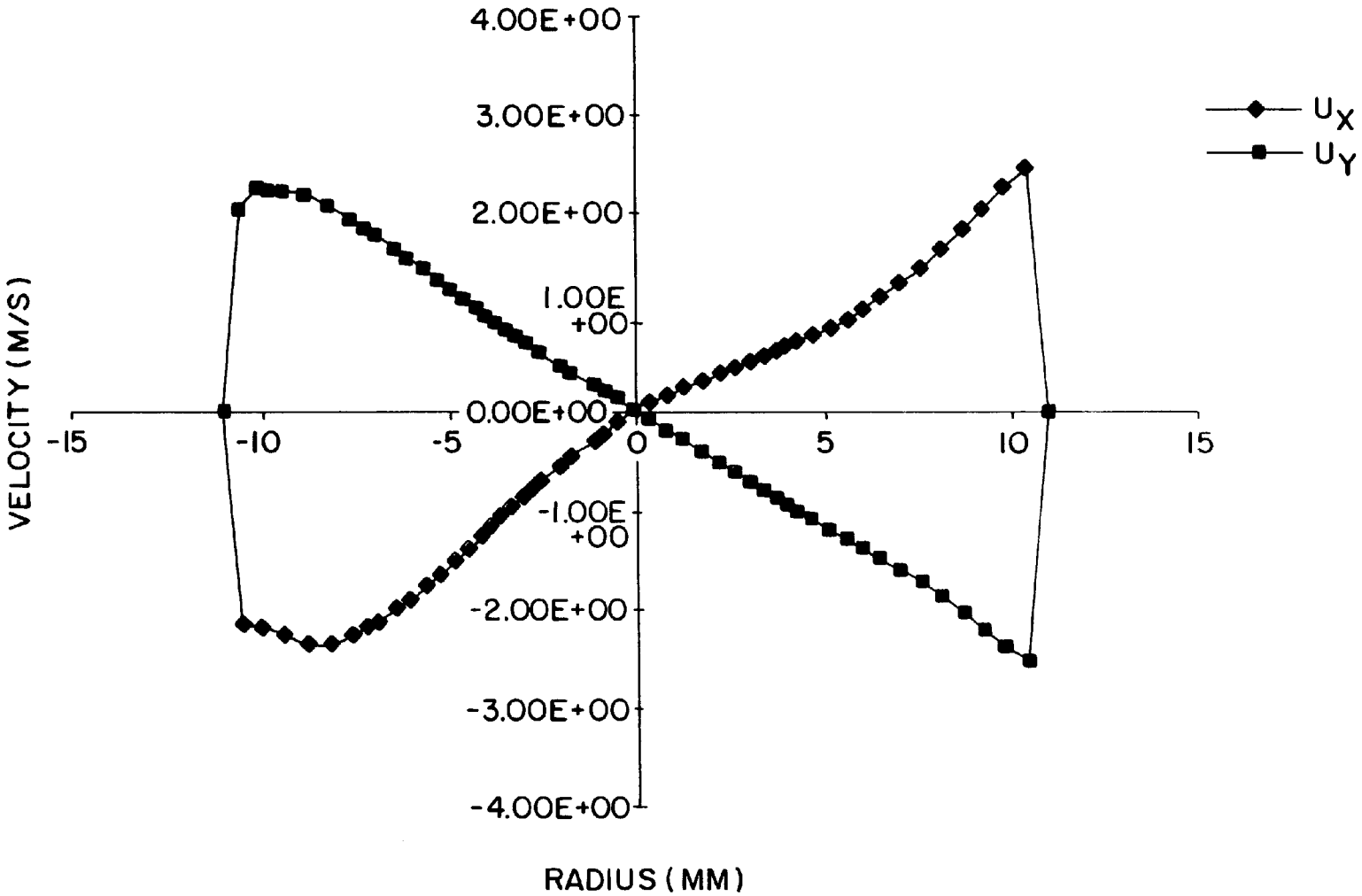
FIG. 30B shows the above one diameter past the end of the fins.

In FIGS. 21–23, in order to achieve the largest level of swirl in the small diameter tube 120, the spiral fins 122, 124, and 126 are designed to follow a spiral tubular section where all of the flow 128 has to pass through one of the spiral tubular passages. This will guide most of the flow 128 through the spiral section of the fins 122, 124, and 126, instead of the middle bore section. Since as shown in FIG. 23, most of the flow 128 follows the spiral streamline parallel to the fin surface, the swirl number will be increased. This is because the swirl number, as defined above, is proportional to the integral of the mass of fluid times the angular to axial momentum ratio. The larger the mass of fluid undergoing the swirl motion, the larger the swirl number. More details on this system is provided below. The closed core 130 in the spiral section followed by the open core in the downstream section provides a much higher swirl number in a smaller diameter tube.

With a wide diameter tube, e.g., greater than 27 millimeters inner diameter (ID), three (3) internal fins were found optimal when used in the described embodiments, the wide diameter tube allowing for an open center without the fins extending to a solid central core. It has been observed that with such wide diameter tubes, i.e., greater than approximately 27 or 28 millimeters, the vortex strength is sufficiently large using the open core embodiment. In many paper machine headboxes, however, the ID is often limited to approximately only 20 millimeters, and thus as shown in FIGS. 21–23, the tube design utilizes a solid center core 130 upstream with a partially solid and partially open tube embodiment to generate the sufficient amount of vortex strength desired in the smaller diameter tube 120. This is much more difficult to fabricate and manufacture, and thus while the larger diameter tube is preferred with the open core, often in the particular paper machine application, the parameters result in a limited diameter, i.e., less than 27 millimeters, in which to generate the same amount of vorticity in the smaller area.

With reference to FIGS. 24–30 discussed further below, the geometry of mesh flow diagrams illustrates the axial velocity components of the vorticity generated with the described tube 120 embodiment of FIGS. 21–23. Whereas the solid core 130 facilitates the sufficient vortex strength, it should be appreciated that the use of an open core in the small diameter tube, of a sufficient opening to avoid plugging of the tube, requires an opening such that the fluid flow 128 through the tube towards the center of the tube, without experiencing the rotating effects of the fins 122, 124, and 126. Thus, where the diameter of the tube is small, e.g., ID less than 27 millimeters, then to generate the same strength vorticity as the large diameter open central core tube, the open area should be reduced greatly to generate the sufficient velocity vortex, so most of the flow 128 would go between the fins 122, 124, and 126 to experience the rotation. The problem however in practice is that the use of a small open area cannot practically be sufficiently reduced for a tip to tip distance between fins of less than 6 to 7 millimeters due to the potential for fiber stapling which may occur, causing the tube 120 to plug.

As discussed, keeping the area in between the tip of the fin sufficiently large with the small diameter tube 120 causes too much fluid to tend to go straight through the center without experiencing the rotating effects of the fins. Thus, the downstream effect of vorticity would be very weak because most of the fluids would not have been forced to rotate. With the center plugged, as shown in FIGS. 21–23, the solid central core 130 however requires that all of the flow 128 go along the fins 122, 124, and 126 and therefore the fluid is required to initiate a rotational movement as it passes the core and enters the open area downstream in the tube 120. Inside the tube, since the fluid is already experiencing a rotating effect, it tends to fill in between the fins as the flow moves downstream, resulting in a centrifugal force which pushes outwardly, facilitating its sufficiently large vortex strength.

Filling the entire region with a closed core however results in a fluid downstream at the end of the fins having no velocity, thus the fins tend to collect fibers at the tip which creates fiber flocs. Advantageously, with the solid core design of FIGS. 21–23, where the partial core is filled and the downstream half is open, a stronger mixing force results in the core region, where the fins 122, 124, and 126 are still operating. Therefore, any kind of fiber buildup is prevented at the zero velocity point at the down-stream end of the solid core. The plots of FIGS. 24–30 show the effects for fluid flow 128 going in between the fins in the two dimensional views, where the cross vector velocity plots in the cross-sectional plane illustrate the full strength facilitating the flow initially staying around the solid core in between the fins and then mixing while a rotational flow is achieved downstream with the remaining fluid flow.

The axial velocity at different angles downstream is shown as cross sections at the plotted angles, for example, the 22 millimeter diameter tube embodiment illustrates axial velocity at zero, 30, 60, 90, 120, and 150 degrees (180 being the same as zero degrees). As shown, from only 5 millimeters to one diameter (22 millimeters) passed the end of the tubular region, the flow from the straight section is illustrated in which the velocity field quickly becomes uniform. Looking at the stream line velocity component at different cross sections, at the indicated angles, shows the flow going between the fins at a higher velocity than the flow moving along the fins. Thus, the flow around the middle of the fin is at a somewhat higher velocity than the flow near the edge of the fin which is slower but which flow very quickly equilibrates with the remaining fluid flow. With the plot showing 45 degrees at half the fin and one diameter across the fin, the flow is also shown as very quickly becoming more uniform, i.e., the x and y components of the swirling velocity. Accordingly, the tube 120 design of FIGS. 21–23, and the mesh flow diagrams of FIGS. 21–30, illustrate a further approach for enhancing swirl in smaller diameter tubes of the described system with one to two diameters of downstream straight section flow from the tube resulting in the flow achieving a uniform velocity in the nozzle of the headbox.

EXAMPLES

With reference to FIGS. 24–30, these plots and figures are from model D27 which was built in finite element mesh generation program and run using finite element analysis to simulate the above approach. The geometry is as follows:

Tube diameter: 22 mm

Center diameter: 6 mm

Pitch: 40 mm

Rotation: 360 degrees

Number of fins: 3

Fin geometry: Tapered from 3 mm thickness at the base to 1.5 mm at the tip which is rounded.

Center geometry: The center core region is filled with a torpedo shaped block which runs from 3 mm before the start of the fins to 2 mm into the fin section. Before the start of the fins, the block is hemi-spherical. From the start of the fins to 10 mm back, it is a straight circular cylinder. From 10 mm until it ends at 20 mm, it tapers as a cone with a rounded tip. The fins meet the center block at a right angle and with rounds from 0 to 10 mm. At 10 mm, as the block tapers, the fins leave the block and the tips blend quickly from flat to fully rounded.

In the package are twelve plots. These are black and white line plots chosen to reproduce well and be clear at small sizes. In keeping with this, they have minimal labeling.

The first three are engineering design program plots of the geometry of the section containing the fins and center body as described above. (1) shows side and end views, (2) shows only the side view, and (3) shows only the end view. The flow characteristics illustrated, rather than the dimensions (not shown), in FIGS. 23–30 will be readily appreciated by those skilled in the art.

These drawings are followed by a series of nine plots presenting typical results from finite element analysis.

The model was generated in finite element mesh generation program to represent a simplified version of the true geometry. The leading and trailing edge rounds were deleted from the fins and all surface intersections were taken to be sharp. An upstream section of straight circular duct was added with flow entering as a jet of 9 mm diameter and quadratic profile 60 mm upstream of the fins. A straight circular duct of 150 mm length was added to the outlet The volume was meshed with linear brick elements and all external surfaces were meshed with linear tetrahedral elements. The final model contains 361,200 elements with 344,830 nodes.

This model was run simulating water at 40° C. and with a flow rate of 20 gpm. The computational velocity was scaled such that one "unit" of velocity in finite element analysis corresponds to 4 mm/s in reality. This was done to aid convergence. Other properties were adjusted to keep the Reynolds number consistent. The model was set for incompressible, steady, turbulent flow, and used the standard k-epsilon formulation as included in finite element analysis. The inlet boundary condition was given by the flow rate and includes a small inlet component of kinetic energy and dissipation to "kick start" the k-epsilon routine. Wall boundary conditions are the no-slip and impermeability conditions, and, additionally, the wall imposes a Law of the Wall formulation on all volume elements directly touching the wall. The outlet has a free boundary condition. There is a Stokes initial condition applied through the volume for velocity and a uniform low value of kinetic energy and dissipation, again to "kick start" the k-epsilon routine. The simulation converged in 251 iterations and used 279,022 processor seconds (approximately 3.2 days).

The swirl number for this case was calculated by integrating the swirl number along a series of radii 30 degrees apart. It was calculated at 5 mm and one diameter past the fins. The results are given below:

At 5 mm: 0.3156

At 1 dia: 0.2786

It will be appreciated by those skilled in the art that modifications to the foregoing preferred embodiments may be made in various aspects. The present invention is set forth with particularity in the appended claims. It is deemed that the spirit and scope of that invention encompasses such modifications and alterations to the preferred embodiment as would be apparent to one of ordinary skill in the art and familiar with the teachings of the present application.

What is claimed is:

1. A paper forming machine headbox component for receiving a paper fiber stock and generating a jet therefrom for discharge upon a wire component moving in a machine direction (MD), the headbox component comprising:

a distributer for distributing stock flowing into the headbox component in a cross-machine direction (CD), the distributer effective for supplying a flow of said stock across the width of the headbox in the machine direction;

a nozzle chamber having an upper surface and a lower surface converging to form a rectangular outlet lip defining a slice opening for the jet;

a diffuser block coupling said distributer to said nozzle chamber, said diffuser block comprising a multiplicity of tubular elements disposed between said distributer and said nozzle chamber, said tubular elements being oriented axially in the machine direction, a plurality of the tubular elements having a longitudinal axes in the direction of the flow of stock, and the tubular elements arranged within the diffuser block as a matrix of rows and columns for generating multiple jets of said stock flowing into said nozzle chamber; and at least one counter-rotating vortex pair (CVP) generating element mounted at one or more of said plurality of said tubular elements of said diffuser block, said CVP generating element imparting an angular sweep of motion of the fluid for splitting the jet effective for swirling said stock in controlled pairs of axial vortices along the longitudinal axes of the tubular elements as said stock flows through said tubular elements promoting mixing of the jets of said stock as said jets flow into said nozzle chamber from the tubular elements to form a uniform flow of stock at the slice opening for the jet.

2. A headbox component as recited in claim 1 wherein said CVP generating element comprises a protuberance inside one or more of said tubular elements of said diffuser block.

3. A headbox component as recited in claim 2 wherein protuberance is provided at the mid-section of said tubular element.

4. A headbox component as recited in claim 1 wherein said CVP generating element comprises a fluid jet introduced inside one or more of said tubular elements of said diffuser block.

5. A headbox component as recited in claim 4 wherein said fluid jet is introduced at the mid-section of said tubular element.

6. A headbox component as recited in claim 1 wherein said tubular elements being oriented axially generate an axial vorticity which prevents fiber orientation in the machine direction in an initial converging section of said nozzle chamber.

7. A headbox component as recited in claim 1 wherein said diffuser block orienting said tubular elements axially in the machine direction generates machine direction strain and acceleration in said nozzle chamber with a gradual convergence rate near the slice which is not strong enough to orient the fibers an the machine direction.

8. A headbox component as recited in claim 7 wherein the fibers in the forming jet will be isotropic, uniformly oriented in all directions.

9. A paper forming machine headbox component for receiving a paper fiber stock and generating a jet therefrom for discharge upon a wire component moving in a machine direction (MD), the headbox component comprising:

a distributer for distributing stock flowing into the headbox component in a cross-machine direction (CD), the distributer effective for supplying a flow of said stock across the width of the headbox in the machine direction;

a nozzle chamber having an upper surface and a lower surface converging to form a rectangular outlet lip defining a slice opening for the jet;

a diffuser block coupling said distributer to said nozzle chamber, said diffuser block comprising a multiplicity of tubular elements disposed between said distributer and said nozzle chamber, said tubular elements being oriented axially in the machine direction, a plurality of the tubular elements having a longitudinal axes in the direction of the flow of stock, and the tubular elements arranged within the diffuser block as a matrix of rows and columns for generating multiple jets of said stock flowing into said nozzle chamber; and at least one counter-rotating vortex pair (CVP) generating element mounted at one or more of said plurality of said tubular elements of said diffuser block, said CVP generating element being effective for swirling said stock in controlled pairs of axial vortices along the longitudinal axes of the tubular elements as said stock flows through said tubular elements promoting mixing of the jets of said stock as said jets flow into said nozzle chamber from the tubular elements to form a uniform flow of stock at the slice opening for the jet, wherein said CVP comprises a closed core with a spiral section followed by an open core in the downstream section for enhanced swirl.

10. A headbox component as recited in claim 9 wherein said CVP generating element comprises an inlet for an impinging fluid jet introduced inside one or more of said tubular elements of said diffuser block.

11. A headbox component as recited in claim 10 wherein said inlet for the impinging fluid jet is introduced at the mid-section of said tubular element.

12. A headbox component as recited in claim 9 wherein said tubular elements are adapted for being oriented axially in said diffuser block to generate an axial vorticity which prevents fiber orientation in the machine direction in an initial converging section of said nozzle chamber.

13. A headbox component as recited in claim 9 wherein said diffuser block is adapted for orienting said tubular elements axially in the machine direction to generate machine direction strain and acceleration with said nozzle chamber upper and lower surfaces being adapted for a gradual convergence rate near the slice which is not strong enough to orient the fibers in the machine direction.

14. A headbox component as recited in claim 9 wherein said diffuser block is adapted for orienting said tubular elements axially in the machine direction to generate machine direction strain and acceleration with said nozzle chamber upper and lower surfaces being adapted for a gradual convergence rate near the slice which is not strong enough to orient the fibers in the machine direction, and further wherein the fibers in the forming jet will be isotropic, uniformly oriented in all directions.

15. A paper forming method for receiving a paper fiber stock and generating a jet from a headbox component for discharge upon a wire component moving in a machine direction (MD), the method comprising:

distributing stock flowing into the headbox component in a cross-machine direction (CD), to a distributer effective for supplying a flow of the stock across the width of the headbox in the machine direction;

converging the flow of the stock with a nozzle chamber having an upper surface and a lower surface to form a rectangular outlet lip defining a slice opening for the jet;

coupling the distributer to a diffuser block and nozzle chamber having a multiplicity of tubular elements being disposed and oriented axially therebetween in the machine direction with longitudinal axes in the direction of the flow of stock, the tubular elements being arranged within the diffuser block as a matrix of rows and columns for generating multiple jets of the stock flowing into the nozzle chamber; and generating at least one counter-rotating vortex pair (CVP) by an angular sweep of motion of the fluid for splitting the jet at one or more of said plurality of said tubular elements of said diffuser block effective for swirling the stock in controlled pairs of axial vortices along the longitudinal axes of the tubular elements as the stock flows through said tubular elements promoting mixing of the jets of the stock as the jets flow into the nozzle chamber from the tubular elements to form a uniform flow of stock at the slice opening for the jet.

16. A method as recited in claim 15 wherein the generating element introduces a fluid jet inside one or more of the tubular elements of the diffuser block.

17. A method as recited in claim 16 wherein the fluid jet is introduced at the mid-section of the tubular element.

18. A method as recited in claim 15 wherein the tubular elements are oriented axially to generate an axial vorticity which prevents fiber orientation in the machine direction in an initial converging section of the nozzle chamber.

19. A method as recited in claim 15 wherein the tubular elements are oriented axially in the machine direction to generate machine direction strain and acceleration in the nozzle chamber with a gradual convergence rate near the slice which is not strong enough to orient the fibers in the machine direction.

20. A method as recited in claim 19 wherein the generating step isotropically orients the fibers in the forming jet in all directions.

* * * * *